US006512894B2

(12) United States Patent
Takemoto et al.

(10) Patent No.: US 6,512,894 B2
(45) Date of Patent: Jan. 28, 2003

(54) IMAGE FORMING APPARATUS, CONTROL METHOD FOR IMAGE FORMING APPARATUS AND ADMINISTRATING METHOD FOR IMAGE FORMING APPARATUS

(75) Inventors: Kazuhiro Takemoto, Hino (JP); Ryuichiro Kobayashi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/888,142

(22) Filed: Jun. 22, 2001

(65) Prior Publication Data

US 2002/0012541 A1 Jan. 31, 2002

(30) Foreign Application Priority Data

Jun. 26, 2000 (JP) ..... 2000-191061

(51) Int. Cl.[7] ..... G03G 15/00
(52) U.S. Cl. ..... 399/12; 399/24

(58) Field of Search ..... 399/8, 9, 12, 13, 399/24, 25, 27

(56) References Cited

U.S. PATENT DOCUMENTS 4,961,088 A * 10/1990 Gilliland et al. ..... 399/25
5,956,541 A * 9/1999 Hoshika et al. ..... 399/24
6,351,618 B1 * 2/2002 Pollocks, Jr. ..... 399/12

* cited by examiner

*Primary Examiner*—Hoan Tran
(74) *Attorney, Agent, or Firm*—Cantor Colburn LLP

(57) ABSTRACT

An image forming apparatus includes an image forming section having a detachable process cartridge provide with identification information; an identification information reading section to read the identification information of the process cartridge; and a control section to control the image forming apparatus on a basis of a comparison result between the identification information and license presence/absence judgment information used for judging whether the process cartridge is licensed or not.

22 Claims, 9 Drawing Sheets

IMAGE FORMING APPARATUS, CONTROL METHOD FOR IMAGE FORMING APPARATUS AND ADMINISTRATING METHOD FOR IMAGE FORMING APPARATUS

BACKGROUND OF THE INVENTION

The present invention relates to an image forming apparatus, a control method for the image forming apparatus and an administrating method for the image forming apparatus that are used for copying machines and printers.

In recent years, consumables of electrophotographic or inkjet printers are made so that they are replaced or replenished as a single body type cartridge (or a unified cartridge, a process cartridge) in which photosensitive materials and developers etc. are incorporated.

These process cartridges are devised so that they can be collected after use, remanufactured by replenishing or replacing consumables, and provided for reuse.

Further, in recent years, since a plurality of manufacturers has come to provide the process cartridges of the same configurations, distribution channels of the cartridge collection and remanufacturing have become rather complex.

In these circumstances, there has been generated a problem that which manufacturer is charged to collect the costs of collecting and remanufacturing the process cartridges.

For example, in cases where Company B remanufactures the process cartridge manufactured by Company A, Company B should primarily collect the costs of collecting and remanufacturing the process cartridge. In many cases in the present distribution system, the costs are added onto the sales price of the process cartridge, or remanufacturing cost are collected from users at the time of collecting the cartridge.

In the above circumstances, each cartridge manufacturer is not assured to collect the appropriate costs for manufacturing and collecting the cartridge.

Meanwhile, in many cases, various exclusive rights such as patent rights and trademark rights etc. exist for the process cartridges. In order to manufacture, remanufacture and sell the process cartridges, it is necessary to obtain licenses for the above rights.

Heretofore, to obtain the licenses for the above-mentioned rights, manufacturers and sellers of the process cartridge generally pay the license fees to the licensors.

Conventionally, transfer of the license fees concerning exclusive rights have been executed among manufacturers, sellers and licensors, but administration of the license fees according to the sales volume is usually done on a yearly or monthly basis etc., therefore, there have been problems that the load for the administration is heavy and the time lag before payment is long.

SUMMARY OF THE INVENTION

An object of the present invention is to provide an image forming apparatus, a control method for the image forming apparatus and an administrating method for the image forming apparatus that minimize the above mentioned problems, and particularly to provide an image forming apparatus, a control method for the image forming apparatus and an administrating method for the image forming apparatus that enable effective collection of remanufacturing and collecting costs etc. for the process cartridge, and further to clarify the allocation of the accompanying costs to the remanufacturers, and collecting companies.

A further object of the present invention is to provide an image forming apparatus, a control method for the image forming apparatus and an administrating method for the image forming apparatus, wherein the load of administering the usage fee payment is decreased, and users can choose a more reasonable way to meet the usage fee payment, by conducting a charge collection and a license fee settlement for the exclusive rights of patents, trademarks etc. accompanying the process cartridge, at the time of use of the process cartridge.

The inventors of the present invention found that the objects of the present invention can be attained by any one of the following structures.

(1–1) An image forming apparatus, comprises:

an image forming section having a detachable process cartridge provided with identification information;

an identification information reading section to read the identification information of the process cartridge; and a control section to control the image forming apparatus on a basis of a comparison result between the identification information and license presence/absence judgment information used for judging whether the process cartridge is licensed or not.

(1–2) In the image forming apparatus of (1–1), the image forming apparatus further comprises:

a network connecting section to connect with a network;

an identification information transmitting section to transmit the identification information to a server having the license presence/absence judgment information through the network connecting section; and a license information obtaining section to obtain license information generated in the server on a basis of the comparison result between the identification information and the license presence/absence judgment information through the network connecting section;

wherein the control section controls the image forming section on a basis of the license information obtained by the license information obtaining section.

(1–3) In the image forming apparatus of (1–2), the image forming apparatus further comprises:

an electronic information storing section to store electronic information corresponding to the license information; and a comparing section to compare the license information obtained by the license obtaining section with the electronic information stored in the electronic information storing section;

wherein the control section controls the image forming section on a basis of a comparison result between the license information and the electronic information by the comparing section.

(1–4) In the image forming apparatus of (1–2), the license information is encrypted and the image forming apparatus further comprises a decrypting section to decrypt the encrypted license information.

(1–5) In the image forming apparatus of (1–2), the image forming apparatus further comprises:

an electronic settlement server connecting section to connect through the network connecting section with an electronic settlement server to electronically settle a payment on a basis of the license information.

(1–6) In the image forming apparatus of (1–5), the image forming apparatus further comprises:

an electronic settlement proceeding section to conduct settling a use fee on a basis of the license information.

(1–7) In the image forming apparatus of (1–2), the process cartridge comprises a toner accommodating section to accommodate toner and a residual toner amount detecting section to detect an amount of residual toner remaining in the toner accommodating section.

(1–8) In the image forming apparatus of (1–7), in a case that the license information obtained by the license information obtaining section has information indicating "no license", the control section restricts or stops a function of the image forming section when the residual toner amount detecting section detects a predetermined amount of residual toner.

(1–9) In the image forming apparatus of (1–1), the image forming apparatus further comprises:

a network connecting section to connect with a network;

a license presence/absence judgment information obtaining section to obtain the license presence/absence judgment information from a server of the network through the network connecting section; and a comparing section to compare the license presence/absence judgment information with the identification information;

wherein the control section controls the image forming section on a basis of a comparison result by the comparing section.

(1–10) In the image forming apparatus of (1–9), the image forming apparatus further comprises:

an electronic information storing section to store electronic information corresponding to the license presence/absence judgment information;

wherein the comparing section compares the license presence/absence judgment information obtained by the license presence/absence judgment information obtaining section with the electronic information stored in the electronic information storing section and the control section controls the image forming section on a basis of a comparison result between the license presence/absence judgment information and the electronic information by the comparing section.

(1–11) In the image forming apparatus of (1–9), the license presence/absence judgment information is encrypted and the image forming apparatus further comprises a decrypting section to decrypt the encrypted license presence/absence judgment information.

(1–12) In the image forming apparatus of (1–9), the image forming apparatus further comprises:

an electronic settlement server connecting section to connect through the network connecting section with an electronic settlement server to electronically settle a payment in the network on a basis of the comparison result between the identification information and the license presence/absence judgment information.

(1–13) In the image forming apparatus of (1–12), the image forming apparatus further comprises:

an electronic settlement proceeding section to conduct settling a use fee on a basis of the comparison result between the identification information and the license presence/absence judgment information.

(1–14) In the image forming apparatus of (1–9), the process cartridge comprises a toner accommodating section to accommodate toner and a residual toner amount detecting section to detect an amount of residual toner remaining in the toner accommodating section.

(1–15) In the image forming apparatus of (1–14), in the case that the comparing section judges "no license" as a comparison result between the identification information and the license presence/absence judgment information, the control section restricts or stops a function of the image forming section when the residual toner amount detecting section detects a predetermined amount of residual toner.

(1–16) A method of controlling an image forming apparatus comprising an image forming section having a detachable process cartridge provided with identification information, comprising the steps of:

reading the identification information of the process cartridge;

comparing the identification information with license presence/absence judgment information used for judging whether the process cartridge is licensed or not; and controlling the image forming section on a basis of a comparison result.

(1–17) In the method of (1–16), the method further comprises a step of connecting the image forming apparatus with a network; and a step of transmitting the identification information to a server in the network through the network, wherein the step of comparing is conducted in the server; and further comprising a step of generating license information on a basis of a comparison result between the identification information and the license presence/absence judgment information in the server; and wherein the controlling step controls the image forming apparatus on a basis of the license information.

(1–18) In the method of (1–16), the controlling step controls the image forming apparatus on a basis of the comparison result between the identification information and the license presence/absence judgment information.

(1–19) In the method of (1–18), the method further comprises a step of connecting the image forming apparatus with a network; and a step of obtaining the license presence/absence judgment information through the network and the comparing step is conducted in the image forming apparatus.

Further, the objects of the present invention may be attained by the following preferable structures.

(2–1) In an image forming apparatus having a loading/unloading means for license information recording media onto an image forming means, and a control means which controls the functions of the image forming means in accordance with the license information, the image forming apparatus of the present invention is characterized in that the image forming apparatus comprises a license information reading means that reads the license information from license information recording media, an electronic information memorizing means that memorizes the electronic information corresponding to the license information, and a comparing means that compares the electronic information with the license information, and the control means controls functions of the image forming means based on the comparison result by the comparing means.

(2–2) The image forming apparatus described in the above paragraph (2–1) is characterized by having a read-out completion information writing means for writing read-out completion information after reading the license information from the license information recording media.

(2–3) The image forming apparatus described in above paragraph (2–1) or (2–2) is characterized in that the license information is encrypted and the image forming apparatus has a decrypting means that decrypts the encrypted license information.

(2–4) In the image forming apparatuses described in any one of paragraphs (2–1) through (2–3), the apparatus is characterized in that the image forming means has a detachable process cartridge and the process cartridge has a toner accommodating means and a residual toner detecting means that detects the amount of toner remaining in the toner accommodating means.

(2–5) In the image forming apparatus described in any one of the above paragraphs (2–1) through (2–4), when the residual toner detecting means detects a predetermined amount of the residual toner, the control means controls the image forming means so as to restrict or stop the function of the image forming means based on the comparison result.

(2–6) In an image forming apparatus comprising a loading/unloading mechanism of the process cartridge having the license information, and a control means that controls the function of image forming means in accordance with the license information, the image forming apparatus of the present invention is characterized in that, the image forming means comprises a license information reading means that read the license information of the process cartridge, an electronic information memorizing means that memorizes the electronic information corresponding to the license information, and a comparing means that compares the electronic information to the license information, and the control means controls the functions of the image forming means based on the comparison result of the comparing means.

(2–7) In the image forming apparatus described in paragraph (2–6), the license information is encrypted and a decrypting means that decrypts the encrypted license information is provided.

(2–8) In an image forming apparatus described in paragraphs (2–6) or (2–7), the process cartridge comprises a toner accommodating means and a residual toner detecting means that detects the amount of toner remaining in the toner accommodating means, and when the residual toner detecting means detects a predetermined amount of residual toner, the control means controls the image forming means so as to restrict or stop the respective functions.

(2–9) In a control method for the image forming apparatus comprising a loading/unloading mechanism for the process cartridge, which has the license information, onto an image forming process and a control process that controls the functions of the image forming process in accordance with the license information, the control method for the image forming apparatus of the present invention is characterized in that the image forming apparatus comprises a license information reading process that reads the license information of the process cartridge, an electronic information memorizing process that memorizes the electronic information corresponding to the license information, and a comparing process that compares the electronic information with the license information, and the control process controls the functions of the image forming process based on the comparison result of the comparing process.

(2–10) In the control method for the image forming apparatus described in paragraph (2–9), a writing process for complete reading of information that writes the data of completion of reading the license information from the license information recording media, is provided.

(2–11) In the control method for the image forming apparatus described in paragraph (2–9) or (2–10), the license information is encrypted, and a decrypting process that decrypts the encrypted license information is provided.

(2–12) In the control method for the image forming apparatus described in any one of the above paragraphs (2–9) through (2–11), the image forming process has a detachable process cartridge, and the process cartridge comprises a toner containing process and a residual toner detecting process that detects the amount of toner remaining in the toner containing process.

(2–13) In the control method for the image forming apparatus described in any one of paragraphs (2–9) through (2–12), the control process controls the image forming process so as to restrict or stop the functions, based on the comparison result, when a predetermined amount of the residual toner is detected.

(2–14) In a control method for the image forming apparatus comprising the loading/unloading mechanism of the process cartridge having the license information and the control process that controls the functions of image forming process in accordance with the license information, the control method for the image forming apparatus of the present invention is characterized in that the image forming apparatus comprises a license information reading process that reads the license information of the process cartridge, an electronic information memorizing process that memorizes the electronic information corresponding to the license information, and a comparing process that compares the electronic information to the license information, and the control process controls the functions of the image forming process based on the comparison result by the comparing process.

(2–15) In the control method for the image forming apparatus described in paragraph (2–14), the license information is encrypted and a decrypting process that decrypts the encrypted license information is provided.

(2–16) In the control method for the image forming apparatus described in paragraph (2–14) or (2–15), the process cartridge comprises a toner containing process and a residual toner detecting process that detects the amount of toner remaining in the toner containing process, and when the residual toner detecting process detects the predetermined amount of residual toner, the control process controls the image forming apparatus so as to restrict or stop the functions.

(2–17) In an image forming apparatus having a control means that controls the functions of the image forming means by receiving the license information via a network, the image forming apparatus of the present invention is characterized in that the image forming apparatus comprises a network connecting means for connecting to a network, a license information receiving means that receives the license information from a license granting server connected via the network connecting means, an electronic information memorizing means that memorizes the electronic information corresponding to the license information, and a comparing means that compares the electronic information with the license information, and the control means controls the functions of the image forming means based on the comparison result of the comparing means.

(2–18) In the image forming apparatus described in paragraph (2–17), the license information is encrypted, and a decrypting means that decrypts the encrypted license information is provided.

(2–19) In the image forming apparatus described in paragraph (2–17) or (2–18), the image forming apparatus has an electronic settlement server connecting means that connects to an electronic settlement server via a network, based on the license information.

(2–20) In the image forming apparatus described in paragraph (2–19), the image forming apparatus has an electronic settlement proceeding means for the settlement of the usage fee based on the license information.

(2–21) In the image forming apparatus described in any one of paragraphs (2–17) through (2–20), the image forming means has a detachable process cartridge, and the process cartridge comprises a toner accommodating means and a residual toner detecting means that detects the amount of toner remaining in the toner accommodating means.

(2–22) In the image forming apparatus described in paragraph (2–21), the control means controls the image forming means so as to restrict or stop the functions based on the license information, when the residual toner detecting means detects the predetermined amount of residual toner.

(2–23) In the image forming apparatus described in any one of paragraphs (2–17) through (2–22), the license information includes the settlement status information of the usage fee of the process cartridge.

(2–24) In an image forming apparatus having control means that controls the functions of the image forming means by receiving the license information via a network, the image forming apparatus of the present invention is characterized in that the image forming apparatus comprises a detachable process cartridge with identification information, an identification information reading means that reads the identification information of the process cartridge, a network connecting means for connecting to a network, a license information receiving means that receives the license information from a license granting server connected via the network connecting means, and a comparing means that compares the license information with the identification information, and the control means controls the functions of the image forming means based on the comparison result of the comparing means.

(2–25) In the image forming apparatus described in paragraph (2–24), the license information is encrypted, and a decrypting means to decrypt the encrypted license information is provided.

(2–26) In the image forming apparatus described in paragraph (2–24) or (2–25), the image forming apparatus has an electronic settlement server connecting means that connects to an electronic settlement server via a network, based on the license information.

(2–27) In the image forming apparatus described in paragraph (2–26), the image forming apparatus has an electronic settlement proceeding means for the settlement of usage fee based on the license information.

(2–28) In the image forming apparatus described in any one of paragraphs (2–24) through (2–27), the process cartridge comprises a toner accommodating means and a residual toner detecting means that detects the amount of toner remaining in the toner accommodating means, and when the residual toner detecting means detects a predetermined amount of residual toner, the control means controls the image forming means so as to restrict or stop the functions.

(2–29) In the image forming apparatus described in any one of paragraphs (2–24) through (2–28), the license information includes the settlement status information of the process cartridge usage fee.

(2–30) In a control method for the image forming apparatus having a control process that controls the functions of the image forming process by receiving the license information via a network, the control method for the image forming apparatus of the present invention is characterized in that the image forming apparatus comprises a network connecting process for connecting to a license granting server via a network, a license information receiving process that receives the license information from the license granting server, an electronic information memorizing process that memorizes the electronic information corresponding to the license information, and a comparing process that compares the electronic information to the license information, and the control process controls the functions of the image forming process based on the comparison result by the comparing process.

(2–31) In the control method for the image forming apparatus described in the above paragraph (2–30), the license information is encrypted and a decrypting process that decrypts the encrypted license information is provided.

(2–32) In the control method for the image forming apparatus described in paragraph (2–30) or (2–31), the image forming apparatus has an electronic settlement server connecting process that connects to an electronic settlement server via a network, based on the license information.

(2–33) In the control method for the image forming apparatus described as in the above paragraph (2–32), the image forming apparatus has an electronic settlement procedure process for conducting the usage fee settlement based on the license information.

(2–34) In the control method for the image forming apparatus described in any one of paragraphs (2–30) through (2–33), the image forming process has a detachable process cartridge, and the process cartridge comprises a toner containing process and a residual toner detecting process that detects the amount of toner remaining in the toner containing process.

(2–35) In the control method for the image forming apparatus described in any one of paragraphs (2–30) through (2–34), the control process controls the image forming process so as to restrict or stop the functions, based on the license information, when a predetermined amount of the residual toner is detected.

(2–36) In the control method for the image forming apparatus described in any one of paragraphs (2–30) through (2–35), the license information includes the settlement status information of the usage fee of process cartridge.

(2–37) In a control method for the image forming apparatus having a control process that controls the functions of the image forming process by receiving the license information via a network, the control method for the image forming apparatus of the present invention is characterized in that the image forming apparatus comprises a detachable process cartridge with identification information, an identification information reading process that reads the identification information of the process cartridge, a network connecting process for connecting to a network, a license information receiving process that receives the license information from a license granting server connected via the network connecting process, and also a comparing process that compares the license information to the identification information, and the control process controls the functions of the image forming process based on the comparison result by the comparing process.

(2–38) In the control method for the image forming apparatus described in the above paragraph (2–37), the license information is encrypted and a decrypting process that decrypts the encrypted license information is provided.

(2–39) In the control method for the image forming apparatus described in paragraph (2–37) or (2–38), the image forming apparatus has an electronic settlement server connecting process that connects to an electronic settlement server via a network, based on the license information.

(2–40) In the control method for the image forming apparatus described in paragraph (2–39), the image forming apparatus has an electronic settlement procedure process for conducting the usage fee settlement based on the license information.

(2–41) In the control method for the image forming apparatus described in any one of paragraphs (2–37) through (2–40), the process cartridge comprises a toner containing process and a residual toner detecting process that detects the amount of toner remaining in the toner containing process, and the control process controls the image forming process so as to restrict or stop the functions, based on the license information, when a predetermined amount of the residual toner is detected.

(2–42) In the control method for the image forming apparatus described in any one of paragraphs (2–37) through (2–41), the license information includes the settlement status information of the process cartridge usage fee.

(2–43) In an image forming apparatus having an administration means that administers the functions of the image forming means by receiving the license information via a network, the image forming apparatus of the present invention is characterized in that the image forming apparatus comprises a network connecting means for connecting to a license granting server via a network, a license information receiving means that receives the license information from a license granting server, an electronic information memorizing means that memorizes the electronic information corresponding to the license information, and a comparing means that compares the electronic information with the license information, and the administration means administers the functions of the image forming means based on the comparison result by the comparing means.

(2–44) In the image forming apparatus described in paragraph (2–43), the license information is encrypted, and a decrypting means for decrypting the encrypted license information is provided.

(2–45) In the image forming apparatus described in paragraph (2–43) or (2–44), the administration means comprises an electronic settlement server connecting means that connects to an electronic settlement server via a network.

(2–46) In the image forming apparatus described in the above paragraph (2–45), the administration means has, in the electronic settlement server, a settlement proceeding means for conducting settlement based on the license information.

(2–47) In the image forming apparatus described in any one of paragraphs (2–43) through (2–46), the image forming means has a detachable process cartridge, and the process cartridge comprises a toner accommodating means and a residual toner detecting means that detects the amount of residual toner in the toner accommodating means.

(2–48) In the image forming apparatus described in paragraph (2–47), the administration means administers the image forming means so as to restrict or stop the functions based on the license information, when the residual toner detecting means detects the predetermined amount of residual toner.

(2–49) In the image forming apparatus described in any one of above paragraphs (2–43) through (2–48), the license information includes the settlement status information of the process cartridge usage fee.

(2–50) In an image forming apparatus having an administration means that administers the functions of the image forming means by receiving the license information via a network, the image forming apparatus of the present invention is characterized in that the image forming apparatus comprises a detachable process cartridge having identification information, an identification information reading means that reads the identification information of the process cartridge, a network connecting means for connecting to a network, a license information receiving means that receives the license information from a license granting server connected via the network connecting means, and a comparing means that compares the license information to the identification information, and the administration means controls the functions of the image forming means based on the comparison result by the comparing means.

(2–51) In the image forming apparatus described in above paragraph (2–50), the license information is encrypted and a decrypting means to decrypt the encrypted information is provided.

(2–52) In the image forming apparatus described in above paragraph (2–50) or (2–51), the administration means comprises an electronic settlement server connecting means that connects to an electronic settlement server via a network.

(2–53) In the image forming apparatus described in above paragraph (2–52), the administration means has, in the electronic settlement server, a settlement proceeding means for conducting settlement based on the license information.

(2–54) In the image forming apparatus described in any one of above paragraphs (2–50) through (2–53), the process cartridge comprises a toner accommodating means and a residual toner detecting means that detects the amount of toner remaining in the toner accommodating means, and the administration means administers the image forming means so as to restrict or stop the functions, based on the license information, when a predetermined amount of residual toner is detected.

(2–55) In the image forming apparatus described in any one of above paragraphs (2–50) through (2–54), the license information includes the settlement status information of the process cartridge usage fee.

(2–56) In an administrating method for the image forming apparatus having an administration process that administers the functions of the image forming process by receiving the license information via a network, the administrating method for the image forming apparatus of the present invention is characterized in that the image forming apparatus comprises a network connecting process for connecting to a license granting server via a network, a license information receiving process that receives the license information from the license granting server, an electronic information memorizing process that memorizes the electronic information corresponding to the license information, and a comparing process that compares the electronic information to the license information, and the administration process administers the functions of the image forming process based on the comparison result by the comparing process.

(2–57) In the administrating method for the image forming apparatus described in above paragraph (2–56), the license information is encrypted, and a decrypting process to decrypt the encrypted license information is provided.

(2–58) In the administrating method for the image forming apparatus described in above paragraph (2–56) or (2–57), the administration process comprises an electronic settlement server connecting process that connects to an electronic settlement server via a network based on the license information.

(2–59) In the administrating method for the image forming apparatus described in above paragraph (2–58), in the electronic settlement server, the administration process comprises a settlement procedure process for conducting settlement based on the license information.

(2–60) In the administrating method for the image forming apparatus described in any one of above paragraphs (2–56) through (2–59), the image forming process has a detachable process cartridge, and the process cartridge comprises a toner containing process and a residual toner detecting process that detects the amount of toner remaining in the toner containing process.

(2–61) In the administrating method for the image forming apparatus described in above paragraph (2–60), the administration process comprises a control process that controls the image forming process so as to restrict or stop the functions, based on the license information, when a predetermined amount of residual toner is detected.

(2–62) In the administrating method for the image forming apparatus described in any of above paragraphs (2–56) through (2–61), the license information includes settlement status information of the process cartridge usage fee.

(2–63) In an administrating method for the image forming apparatus having an administration process that administers the functions of the image forming process by receiving the license information via a network, the administrating method for the image forming apparatus of the present invention is characterized in that the image forming apparatus comprises a detachable process cartridge with identification information, an identification information reading process that reads the identification information of the process cartridge, a network connecting process for connecting to a network, a license information receiving process that receives the license information from a license granting server connected via a network connecting process, and a comparing process that compares the license information with the identification information, and the administration process controls the functions of the image forming means based on the comparison result by the comparing means.

(2–64) In the administrating method for the image forming apparatus described in above paragraph (2–63), the license information is encrypted, and a decrypting process to decrypt the encrypted license information is provided.

(2–65) In the administrating method for the image forming apparatus described in above paragraph (2–63) or (2–64), the administration process has an electronic settlement server connecting process that connects to an electronic settlement server via a network, based on the license information.

(2–66) In the administrating method for the image forming apparatus described in above paragraph (2–65), the administration process has a settlement procedure process for conducting settlement based on the license information, in the electronic settlement server.

(2–67) In the administrating method for the image forming apparatus described in any one of above paragraphs (2–63) through (2–66), the process cartridge comprises a toner containing process and a residual toner detecting process that detects the amount of toner remaining in the toner containing process, and the administration process administers the image forming process so as to restrict or stop the functions, based on the license information, when the residual toner detecting process detects the predetermined amount of residual toner.

(2–68) In the administrating method for the image forming apparatus described in any one of above paragraphs (2–63) through (2–67), the license information includes settlement status information of the process cartridge usage fee.

DETAILED DESCRIPTION OF THE PREFERRED EMBODIMENT

Figure 1:
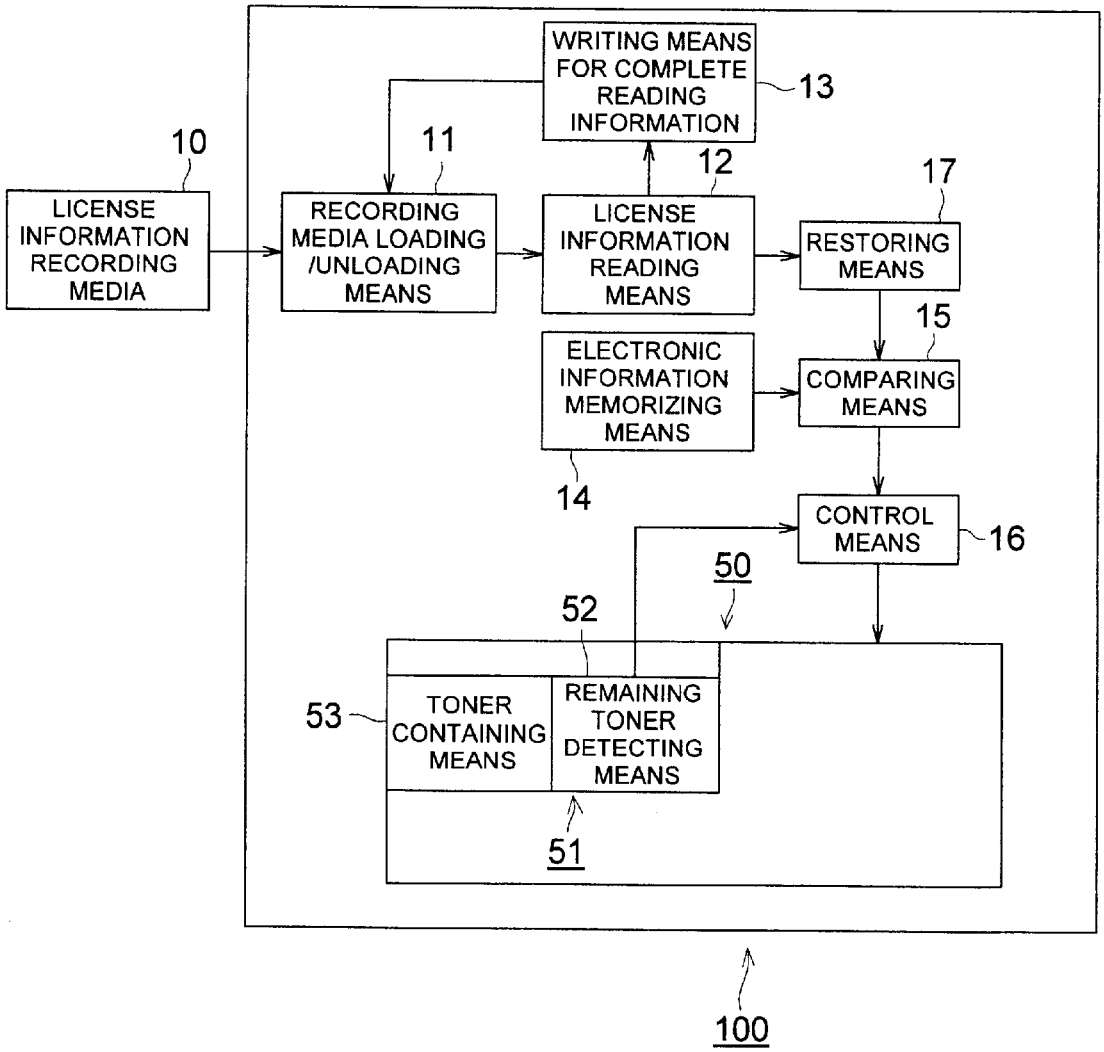
FIG. 1 is a block diagram showing an image forming apparatus having a recording media loading/unloading means onto an image forming means, which accept a license information recording media, and a control means which controls functions of an image forming means according to the license information.

An image forming apparatus of the present invention comprises an image forming means (section), and the image forming means has a detachable process cartridge. In addition, the process cartridge has identification information. The image forming apparatus, further, comprises an identification information reading means (section) for reading the identification information of the process cartridge, a network connecting means (section) for connecting to a network, and a control means for controlling the image forming means. Further the control means (section) controls the image forming means based on compared result of the identification information with license presence/absence judgment information, which is used to judge whether the process cartridge is licensed or not.

Here, the term "the process cartridge is licensed" means that the manufacturer of the printer or the cartridge granted the right for using the cartridge in the image forming apparatus, according to payment of a usage fee which includes a patent license fee and a cartridge collecting fee, etc. by users or cartridge re-manufacturers. Hereafter, the term "license available" will be used to express the situation that "the process cartridge is licensed". On the other hand, in cases where the user or the re-manufacturer has not paid the process cartridge usage fee, and the right to use the process cartridge in the image forming apparatus is not granted by the manufacturer of the printer or the cartridge, the condition will be expressed as "not licensed".

The image forming apparatus of the present invention is an apparatus that forms output images by transferring coloring materials onto the recording media, such as paper or film, and preferably is an electrophotographic image forming apparatus, wherein electrostatic latent images are formed on an electrophotographic photosensitive material, and after the latent images are developed with toner to form toner images, the images are fixed onto the recording media. And as examples of the image forming apparatuses, there is a copying apparatus which makes copies of read originals, a printer apparatus which produces images based on electronic signals transmitted from electronic apparatuses such as computers, and a facsimile apparatus which forms images based on electric signals transmitted via a public telephone line, etc.

The image forming means is a means that forms images on the recording media, such as paper or film, and preferably includes a means for forming latent images on electrophotographic photosensitive materials, a developing means for developing the latent images with toner, and also a fixing means for fixing the developed image by application of heat, in the image forming apparatus.

Further, the process cartridge included in the image forming apparatus is unified and composed of at least two of the following; a developing means, a charging means, an electrophotographic photosensitive material and a electrophotographic cleaning means; and is detachably loaded onto the image forming apparatus main body. For example, the process cartridge disclosed in Tokkaihei 12–132068 can be used.

The identification information provided in the process cartridge is information for identifying each individual process cartridge, and preferably is information comprised of alphanumeric characters. The identification information is provided as the form of character information, image information such as barcode, concavo-convex information, magnetic information and electronic information memorized in memory devices, etc. Manufacture's serial number and serial ID etc. are examples of the identification information. Further, the information that does not identify each of the cartridges and only identifies the manufacturer or the model of the cartridge is acceptable.

The identification information reading means is a means for reading the identification information provided on the process cartridge, and specifically, in case the identification information is optically recorded, the reading means is an optical reading device such as an optical pick-up or optical scanner, in case where the information is magnetically recorded, it is a magnetic reading device such as a magnetic head, and in case the information is electrically recorded, it is an electrical reading device such as connector terminals.

A network connecting means is a generic term including electronic circuits, firmware and software that are used for connecting, physically and logically, the image forming apparatus of the present invention to the network, and specifically comprises a network connecting board and a network connecting software. As examples of a network connecting board, there are: Centronics interface, RS-232C, Universal serial bus (USB), 10 base T, 100 base T, IEEE1394, PCMCI, etc. Examples of protocols of the signals transmitted via the network connecting board are: serial transmission, parallel transmission, Ethernet, TCP/IP, and Netware, etc. The network connecting means connects the image forming apparatus to Local Area Network, Wide Area Network, or the Internet, etc. via a public telephone line, a fixed line, or wireless, etc.

The control means controls the image forming means, and is able to control it so that all of the functions of the image forming apparatus are usable, or part of the functions are restricted, or all the functions are prevented. The control means preferably comprises an MPU (micro processor unit), a CPU (central processor unit), a customized LSI or a gate array, etc. The control means may be called as administration means later in this document.

The license presence/absence judgment information is the information that is used for determining whether the process cartridge is licensed or not. The license presence/absence judgment information, for example, comprises the usage fee settlement status information of each cartridge, and is the information correlating the identification information of the cartridge such as ID numbers, with the usage fee settlement status information. Further, as specific examples, information such as "the process cartridge C-001234 is license available since the usage fee is already paid, C-001239 is license available since the usage fee is already paid, G-012345 is license available since the usage fee is already paid, etc." is preferable.

By comparing the identification information with the license presence/absence judgment information, judgment of whether the process cartridge having it's identification information is license available or not, can be accomplished. In the examples described above, in cases where the identification information of the process cartridge is C-001234, the cartridge is judged to be "license available". In cases of necessity, information of the result of judgment can be generated as the license information, which is described later.

It is preferable that the control means controls the printer so that all the functions are made usable when the process cartridge, with the identification information, is judged to be "license available", as the result of comparing the license presence/absence judgment information with the identification information, and usable functions are restricted, or all the functions are made to be not usable when the cartridge is judged as "not licensed".

Further, as for the embodiment of controlling the image forming means based on the result of comparing the license presence/absence judgment information with the identification information, there are two preferred examples. The first example is an embodiment wherein comparison of the license presence/absence judgment information with the identification information is performed in the apparatus (a server connected to networks, etc.) other than in the image forming apparatus, and the image forming apparatus receives the comparison result the license information (described later), and controls the image forming means based on the license information. The second example is an embodiment, wherein the image forming apparatus compares the license presence/absence judgment information with the identification information, and controls the image forming means based on the comparison result. Details of these two examples are described in the following paragraphs.

A preferable construction of the first example is shown in the following paragraphs.

The image forming apparatus comprises an identification information transmitting means that transmits the identification information to the server in the network via a network connecting means, and a license information receiving means that receives the license information generated based on the comparison result, in the server, of the license presence/absence judgment information with the identification information, via the network connecting means. And the control means controls the image forming means based on the license information received by the license information receiving means.

Here, the license information is the information that indicates whether all the functions of the image forming apparatus in which a certain process cartridge is loaded are usable or not. More specifically, the license information, as numbers or signs indicating the process cartridge to be "license available" or "not licensed", is preferably computerized. Further, the license information is essentially the information indicating the process cartridge to be "license available" or "not licensed", and may further include the license presence/absence judgment information and the usage fee settlement status information for the process cartridge. Furthermore, the license information may include the information such as an electronic signature and ID information, which is used for identifying the license information.

In the embodiment of the first example, the identification information is transmitted from the image forming apparatus to the server via a network. The server has the license presence/absence judgment information, and may also have more detailed settlement status information of the usage fee of the process cartridge. The server, hereinafter, may be called the "license granting server". The comparison of the license presence/absence judgment information with the identification information is performed in the server, not in the image forming apparatus. Further, the server generates the license information indicating "license available" or "not licensed" based on the comparison result. The image forming apparatus receives the license information via the network. The control means controls the image forming means based on the license information received by the license information receiving means.

In the server, as the result of comparing the license presence/absence judgment information with the identification information, it is preferable that if the generated license information has information of "license available", the control means makes all the functions of image forming apparatus usable, however if the generated information has the information of "not licensed", the control means restricts the usable printer functions or makes all the functions unusable.

The identification information transmitting means and/or the license information receiving means may be a device the same as or different than the device of the network connecting means, or some parts of the devices may be used commonly for the plural means. Further, these means may have an MPU (micro processor unit), a CPU (central processing unit), a customized LSI or a gate array.

Further, in cases where the license information has the information for identifying the license information such as an electronic signature or ID information, the embodiment described below is preferable.

The image forming apparatus comprises an electronic information memorizing means that memorizes the electronic information corresponding to the license information (preferably it is the information for identifying the license information), and a comparing means that compares the license information received by the license information receiving means with the electronic information memorized in the electronic information memorizing means. And the control means controls the image forming means based on the comparison result of the license information with the electronic information by the comparing means.

For example, in cases where the license information has the information such as the electronic signature as the information for identifying the license information, the authentic electronic signature is previously memorized as electronic information in the electronic information memorizing means, and when the license information with the electronic signature is received, the electronic signature in the license information is compared with the electronic signature of the electronic information. As the result of the comparison, if the electronic signature in the license information is the same as the electronic signature in the electronic information, then the license information is judged to have the authentic electronic signature. In cases where the license information is judged to have the authentic electronic signature, the control means controls the image forming means based on the license information. By this procedure, erronious operations of the image forming apparatus according to false license information can be prevented.

Here, the electronic information is the information previously determined to conform to the license information and is a kind of "password" for the license information (preferably it is the information for identifying the license information). And the electronic information is preferably the same type of data as the information for identifying the license information. For example, in cases where the license information has an electronic signature, the electronic information is preferably the electronic signature, and in other cases where the license information has ID numbers, the electronic information is preferably ID numbers. In these cases, the electronic information is compared with the license information, and if the electronic information and the information for identifying the license information in the license information conform to each other, the license information can be recognized to be authentic.

The electronic information memorizing means is a so-called memory, and can be either optical, electronic or magnetic memory, and preferably is the type of electronic memory typified by a flash memory and a dynamic RAM.

The comparing means of the electronic information with the license information is the means that compares the electronic information with the license information, whether both of the information conform with each other as the "pass word". The simplest example is a means to compare the electronic information with the license information (preferably it is the information for identifying the license information) whether they are the same or not. The comparing means is preferably provided with an MPU (micro processing unit), a CPU (central processing unit), a customized LSI, or a gate array etc.

Further, in cases where the license information is encrypted, it is preferable that a decrypting means, which decrypts the encrypted license information, is provided. The decrypting means is preferably has an MPU (micro processing unit), a CPU (central processing unit), a customized LSI or a gate array etc.

Further, an electronic settlement server connecting means can be provided that connects to the electronic settlement server in the network, via the network connecting means, based on the license information. In such a case, the image forming apparatus preferably comprises an electronic settlement means for conducting the usage fee settlement based on the license information.

For example, in cases where received license information is "not licensed" and the license is desired, the electronic settlement server connecting means can be operated to connect to the electronic settlement server. And the license can be granted after performing the electronic settlement by the electronic settlement proceeding means.

The electronic settlement server connecting means may be the same device as the device of the identification information transmitting means, the license information receiving means and/or the network connecting means etc., or some parts of the device may be used for plural means. The electronic settlement proceeding means preferably has an MPU (micro processor unit), a CPU (central processing unit), a customized LSI and/or a gate array. And, in order to input instructions for various procedures, an inputting device such as buttons or a keyboard is preferably provided.

Further, in cases where the process cartridge has the toner accommodating means for containing toner, and the residual toner detecting means for detecting the amount of toner remaining in the toner accommodating means, the embodiment described in the following paragraphs is preferable.

In the image forming apparatus, if the license information has the information of "not licensed", in accordance with the residual toner detecting means detecting the predetermined amount of residual toner, the control means preferably restricts or stops the functions of the image forming means.

As an example of the toner accommodating means, a toner cartridge can be used, while for the residual toner detecting means, an optical detecting method, an electrical detecting method and a weight detecting method, etc. can be utilized.

Hereinafter, a preferable construction as the second example is described.

The image forming apparatus comprises the license presence/absence judgment information receiving means that receives the license presence/absence judgment information from the server in the network via the network connecting means, and the comparing means that compares the license presence/absence judgment information with the identification information. After that the control means controls the image forming means based on the comparison result by the comparing means.

In the second example, the license presence/absence judgment information existing in the server is transmitted to the image forming apparatus from the server via the network. And the comparison of the license presence/absence judgment information with the identification information is done by the comparing means in the image forming apparatus. The control means controls the image forming apparatus based on the comparison result.

It is preferable that the control means controls the printer so that all the functions are made usable when the process cartridge with the identification information is judged to be "license available" as the result of comparing the license presence/absence judgment information with the identification information, and usable functions are restricted or all the functions are made to be not usable when the cartridge is judged to be "not licensed".

The license presence/absence judgment information receiving means may be the same as or different from the device of the network connecting means, or some parts of the device may be used commonly for both means. In addition, the means may have an MPU (micro processor unit), a CPU (central processing unit), a customized LSI and/or a gate array.

The comparing means, which compares the license presence/absence judgment information with the identification information, is the means that judges whether the process cartridge having the identification information is "license available" or "not licensed", by comparing the license presence/absence judgment information with the identification information. The comparing means preferably has an MPU (micro processing unit), a CPU (central processing unit), a customized LSI and a gate array.

Further, in the second example, in cases where the license presence/absence judgment information has information, which identifies the license presence/absence judgment information, such as an electronic signature or ID information, the following embodiment is preferable.

The image forming apparatus has an electronic information memorizing means that memorizes the electronic information corresponding to the license presence/absence judgment information (preferably is the information identifying the license presence/absence judgment information), and the comparing means compares the license presence/absence judgment information received by the license presence/absence judgment information receiving means with the electronic information memorized in the electronic information memorizing means, and the control means controls the image forming means based on the comparison result of the license presence/absence judgment information with the electronic information.

In cases where the license presence/absence judgment information has the information for identifying the license presence/absence judgment information such as the electronic signature, the authentic electronic signature is previously memorized as the electronic information in the electronic information memorizing means of the image forming apparatus, and when the license presence/absence judgment information with the electronic signature is received, the electronic signature in the license presence/absence judgment information is compared with the electronic signature of the electronic information. And as the result of the comparison, if the electronic signature in the license presence/absence judgment information is the same as the electronic signature in the electronic information, the license information is judged to have the authentic electronic signature. In cases where the license presence/absence judgment information has the authentic electronic signature, the license presence/absence judgment information is compared with the identification information, and based on the comparing result, the control means controls the image forming apparatus. On the other hand, if the license presence/absence judgment information has an erroneous electronic signature, the comparison of the license presence/absence judgment information with the identification information is not carried out. Further, the license presence/absence judgment information may as well be compared with the electronic information after the comparison of the license presence/absence judgment information with the identification information. By this procedure, erroneous operations of the image forming apparatus due to false license presence/absence judgment information can be prevented.

In cases where the license presence/absence judgment information is encrypted, it is preferable that the decrypting means for decrypting the encrypted license presence/absence judgment information is provided.

It is preferable that an electronic settlement server connecting means is provided, that connects to the electronic settlement server in the network via the network connecting means, based on the comparing result of the license presence/absence judgment information with the identification information. Further an electronic settlement proceeding means for conducting the settlement based on the comparison result of the license presence/absence judgment information with the identification information is preferably provided.

Further, in cases where the process cartridge has a toner accommodating means for containing toner, and a residual toner detecting means for detecting the amount of toner remaining in the toner accommodating means, and the result of comparing the license presence/absence judgment information with the identification information is "not licensed", it is preferable that the control means restricts or stops the functions of the image forming means according as the residual toner detecting means detects the predetermined amount of residual toner.

And yet, among a plurality of means described heretofore to be included in the image forming apparatus in the first and second example, the control means, the comparing means, and the electronic information memorizing means etc. may be included in the other apparatus connected to the image forming apparatus. As the other apparatus, there are a separate control apparatus, and a control server connected to the image forming apparatus via networks, etc.

Regarding as an invention of method, the present invention can be described as follows:

A control method for an image forming apparatus having an image forming means with a detachable process cartridge, comprises a step of reading the identification information of the process cartridge, a step of connecting the image forming apparatus to a network, a step of comparing the identification information with the license presence/absence judgment information which is used to determine whether the process cartridge is licensed or not, and a step of controlling the image forming means based on the result comparison.

The first example of preferable embodiments is as follows: The method of controlling the image forming apparatus comprises a step of transmitting identification information to a server in the network, and a step of comparing the license presence/absence judgment information with the identification information which is conducted in the server, and a step of generating license information based on the result of comparing the license presence/absence judgment information with the identification information which is conducted in the server, and further, a step of controlling the image forming means controls the image forming means based on the license information.

The second example of the preferable embodiment is as follows: The step of controlling the image forming means controls the image forming means according to the comparing result of the license presence/absence judgment information with the identification information. For example, included is a step in which the image forming apparatus receives the license presence/absence judgment information via the network, and the comparing step is conducted in the image forming apparatus.

Descriptions from another point of view are in the following paragraphs.

In an image forming apparatus having, a loading/unloading means for a license information recording media to an image forming means, and a control means which controls functions of the image forming means in accordance with the license information, the image forming apparatus of the present invention is characterized in that the image forming apparatus comprises a license information reading means which reads the license information from license information recording media, an electronic information memorizing means which memorizes the electronic information corresponding to the license information, and a comparing means which compares the electronic information with the license information, and the control means controls functions of the image forming means based on a result of comparison by the comparing means.

Further, in a control method for the image forming apparatus comprising, a loading/unloading mechanism for license information recording media to an image forming process, and a control process that controls the functions of the image forming process in accordance with the license information, the control method for the image forming apparatus of the present invention is characterized in that the image forming apparatus comprises a license information reading process that reads the license information from the license information recording media, an electronic information memorizing process that memorizes the electronic information corresponding to the license information, and a comparing process that compares the electronic information with the license information, and the control process controls the functions of the image forming process based on the comparison result by the comparing process.

Here, the image forming apparatus of the present invention is an apparatus that is capable of forming output images by transferring coloring materials onto the recording media, such as paper or film. The image forming apparatus specifically employs an electrophotographic method wherein, electrostatic latent images are formed on electrophotographic photosensitive material, and after the latent images are developed with toner to form toner images, the images are fixed onto the recording media by heat etc., or an inkjet method wherein, dot-wise jets of ink are emitted from the ends of an ink nozzle array based on electronic signals, and the image forming ink dots are fixed on the recording media, or a thermal ink method wherein, a thermal head array is heated by electric current based on electronic signals, and ink on the ink sheet contacting the thermal head array is heated and melted or sublimated so as to be transferred as images onto the recording media. The image forming apparatus can be used as a copying apparatus which copies original documents, as a printer apparatus which produces images based on electronic signals transmitted from electronic apparatuses such as computers, and/or as a facsimile apparatus which forms images based on electronic signals transmitted via public telephone lines.

License information in the present invention is information that indicates whether all functions of the concerned image forming apparatus is available for use or not, and specifically it is the code numbers or symbols, which are preferably computerized, corresponding to the information of "license available (usable)" or "not licensed (not usable)". Further, the license information includes settlement status information for the usage fee of the process cartridge, which will be described later.

The license information recording media is media in which the license information is previously recorded, and specifically includes, media in which the code numbers or symbols are printed, the media in which bar codes of the code numbers or symbols are printed, and optical or electronic recording media such as floppy disks, magneto-optical disks, optical disks, IC cards and memory cards, etc. in which the computerized code numbers or symbols are memorized.

This image forming means or process is a means or process of forming images on the recording media such as paper or film, and specific examples of the means or process are an electrophotographic method disclosed in Tokkai 2000-132068, and an inkjet method disclosed in Tokkai 2000-127558, etc.

This control means or process is the means or process that issues operation/not-operation instructions to the image forming means according to necessity, and send instructions to the other various means in order for the image forming means to perform good image forming, depending on the operating conditions of the image forming apparatus. Specifically, in the printer apparatus, when after starting use of the printer apparatus, and print volume reaches to the predetermined value, and in case the license information is "not licensed", then the control means conduct a control action, such as to stop operation immediately.

The license information reading means or process is a means or process of reading the license information recorded in the license information recording means, and specifically, in case the license information is optically recorded, the reading means is an optical reading device such as an optical pick-up or optical scanner, in cases where the information is magnetically recorded, it is a magnetic reading device such as a magnetic head, and in cases where the information is electrically recorded, it is an electrical reading device such as connector terminals.

The electronic information is the numeric information commonly used in computer systems, such as a binary notation, quaternary notation, and hexadecimal notation converted from information with redundancy.

The electronic information corresponding to the license information is the information previously determined to conform to the license information, and is a kind of "password" for the license information. The simplest example is the same array of the same numeric characters as that of the license information, and the electronic information has previously been memorized in the memorizing means in the image forming apparatus.

The comparing means or process of the electronic information with the license information is the means or process that compares both of the information whether they conform to each other as "the password". The simplest example is a means to compare the electronic information and the license information to check if they are the same or not.

The image forming apparatus of the present invention, having a loading/unloading mechanism for the process cartridge, which has the license information, onto the image forming means, and a control means that controls the functions of image forming means in accordance with the license information is characterized in that the image forming apparatus comprises, a license information reading means that read the license information of the process cartridge, an electronic information memorizing means that memorizes the electronic information corresponding to the license information, and a comparing means that compares the electronic information with the license information, and the control means controls the functions of the image forming means based on the comparison result of the comparing means.

Further, in a control method for the image forming apparatus, having a loading/unloading mechanism for the process cartridge, which has the license information, onto a image forming process, and a control process that controls the functions of the image forming process in accordance with the license information, the control method for the image forming apparatus of the present invention is characterized in that the image forming apparatus comprises a license information reading process that reads the license information of the process cartridge, an electronic information memorizing process that memorizes the electronic information corresponding to the license information, and a comparing process that compares the electronic information with the license information, and the control process controls the functions of the image forming process based on the comparison result of the comparing process.

Here, the process cartridge of the present invention is unified and composed of at least two of the following means; a developing means, a charging means, an electrophotographic photosensitive material and an electrophotographic cleaning means; and the cartridge is detachably loaded onto the image forming apparatus main body. For example, the process cartridge disclosed in Tokkaihei 12-132068 may be used.

The electronic information memorizing means or process can employ either a method of optical, electronic and magnetic memory, and preferably is the means employing electronic memory method with high reading/writing speed, typified by a flash memory and a dynamic RAM.

The writing means or process for completion reading information is a means or process that writes the data of completion of reading the license information onto the license information recording media. Specifically, in cases where the information is magnetically recorded, the writing means is a magnetic writing device such as a magnetic head, and in case of electronically recorded, the means is an electronic writing device such as connector terminals.

In an image forming apparatus having the control means that controls the functions of the image forming means by receiving the license information via a network, the image forming apparatus of the present invention is characterized in that the image forming apparatus comprises a network connecting means for connecting to a network, a license information receiving means that receives the license information from a license granting server connected via the network connecting means, an electronic information memorizing means that memorizes the electronic information corresponding to the license information, and a comparing means that compares the electronic information with the license information, and the control means controls the functions of the image forming means based on the comparison result by the comparing means.

In a control method for the image forming apparatus having a control process that controls the functions of the image forming process by receiving the license information via a network, the control method for the image forming apparatus of the present invention is characterized in that the image forming apparatus comprises a network connecting process for connecting to a license granting server via a network, a license information receiving process that receives the license information from a license granting server, and an electronic information memorizing process that memorizes the electronic information corresponding to the license information, and a comparing process that compares the electronic information with the license information, and a control process controls the functions of the image forming process based on the comparison result by the comparing process.

In an image forming apparatus having a control means that controls the functions of the image forming means by receiving the license information via a network, the image forming apparatus of the present invention is characterized in that the image forming apparatus comprises a detachable process cartridge with identification information, an identification information reading means that reads the identification information of the process cartridge, a network connecting means for connecting to networks, a license information receiving means that receives the license information from a license granting server connected via the network connecting means, and a comparing means that compares the license information with the identification information, and the control means controls the functions of the image forming means based on the comparison result by the comparing means.

Further, in the control method for this image forming apparatus having the control process that controls the functions of the image forming process by receiving the license information via a network, the control method for the image forming apparatus of the present invention is characterized in that the image forming apparatus comprises a detachable process cartridge with identification information, an identification information reading process that reads the identification information of the process cartridge, a network connecting process for connecting to networks, a license information receiving process that receives the license information from a license granting server connected via the network connecting process, and a comparing process that compares the license information with the identification information, and the control process controls the functions of the image forming process based on the comparison result by the comparing process.

The network in the present invention is media that enable the communication between a plurality of information processing equipment such as servers and personal computers, and specifically, Local Area Network (LAN), Wide Area Network (WAN), and the Internet are examples. Commonly used are various communicating systems and protocols in networks, and the present invention is not particularly restricted to them.

The network connecting means or process is the generic term including electronic circuits, firmware and software that are used for connecting, physically and logically, the image forming apparatus of the present invention to the networks, and specifically comprises a network connecting board and network connecting software.

The license granting server is a server computer that administers the licensing status for the process cartridge being used in the image forming apparatus of the present invention, and the settlement status of the usage fee for the image forming apparatus. The server computer, specifically, memorizes the license information corresponding to the identification information of the process cartridge, and outputs the corresponding information in response to an output request for the license information. The server computer also changes the license information corresponding to the concerned identification information based on instructions for such change.

The license information receiving means or process requests license information output corresponding to the identification information of the process cartridge, and receives the outputted license information.

The identification information is the information for identifying each individual process cartridge of the present invention, and specifically is the production serial number or serial ID.

The identification information reading means is the means for reading the identification information attached to the process cartridge, and specifically, in cases where the identification information is optically recorded, the reading means is an optical reading device such as an optical pick-up or optical scanner, in cases where the information is magnetically recorded, it is a magnetic reading device such as a magnetic head, and in case the information is electrically recorded, it is an electrical reading device such as connector terminals.

In the comparing means, which compares the license information with the identification information, by associating the identification information of the process cartridge, loaded onto the apparatus of the present invention, with the license information, which is received from the license granting server, corresponding to the concerned identification information, when the process cartridge with the same identified information is reloaded, the operation/not-operation control will be conducted based on the license information already acquired.

In an image forming apparatus having an administration means that administers the functions of the image forming means by receiving the license information via a network, the image forming apparatus of the present invention is characterized in that the image forming apparatus comprises a network connecting means for connecting to a license granting server via a network, a license information receiving means that receives the license information from a license granting server, an electronic information memorizing means that memorizes the electronic information corresponding to the license information, and a comparing means that compares the electronic information with the license information, and the administration means controls the functions of the image forming means based on the comparison result by the comparing means.

Further, in an image forming apparatus having an administration means that administers the functions of the image forming means by receiving the license information via a network, the image forming apparatus of the present invention is characterized in that the image forming apparatus comprises a detachable process cartridge with identification information, an identification information reading means that reads the identification information of the process cartridge, a network connecting means for connecting to networks, a license information receiving means that receives the license information from a license granting server connected via the network connecting means, and a comparing means that compares the license information with the identification information, and the administration means controls the functions of the image forming means based on the comparison result by the comparing means.

Herein, the administration means, which administers the functions of the image forming apparatus, issues instruction of operation/not-operation to the image forming means according to need, and sends instructions to the various other means in order for the image forming means to perform good image forming, depending on the operating condition of the image forming apparatus. Specifically, in a printer apparatus, after starting use of the printer apparatus, when the print volume reaches the predetermined value and in case the license information is "not licensed", the administration means conduct the control, such as, to stop operation immediately.

The settlement status information of the process cartridge usage fee is the information of payment status for the process cartridge license fee, which includes remanufacturing costs and collection costs of the process cartridge and license fee for the various exclusive rights belonging to the process cartridge such as patent rights and trademark rights, and the information is memorized and administered by being associated with the ID number of the process cartridge.

Embodiments of the present invention will be described in detail in the following paragraphs.

Referring to the drawings, the embodiments of the present invention will now be described.

Figure 5:
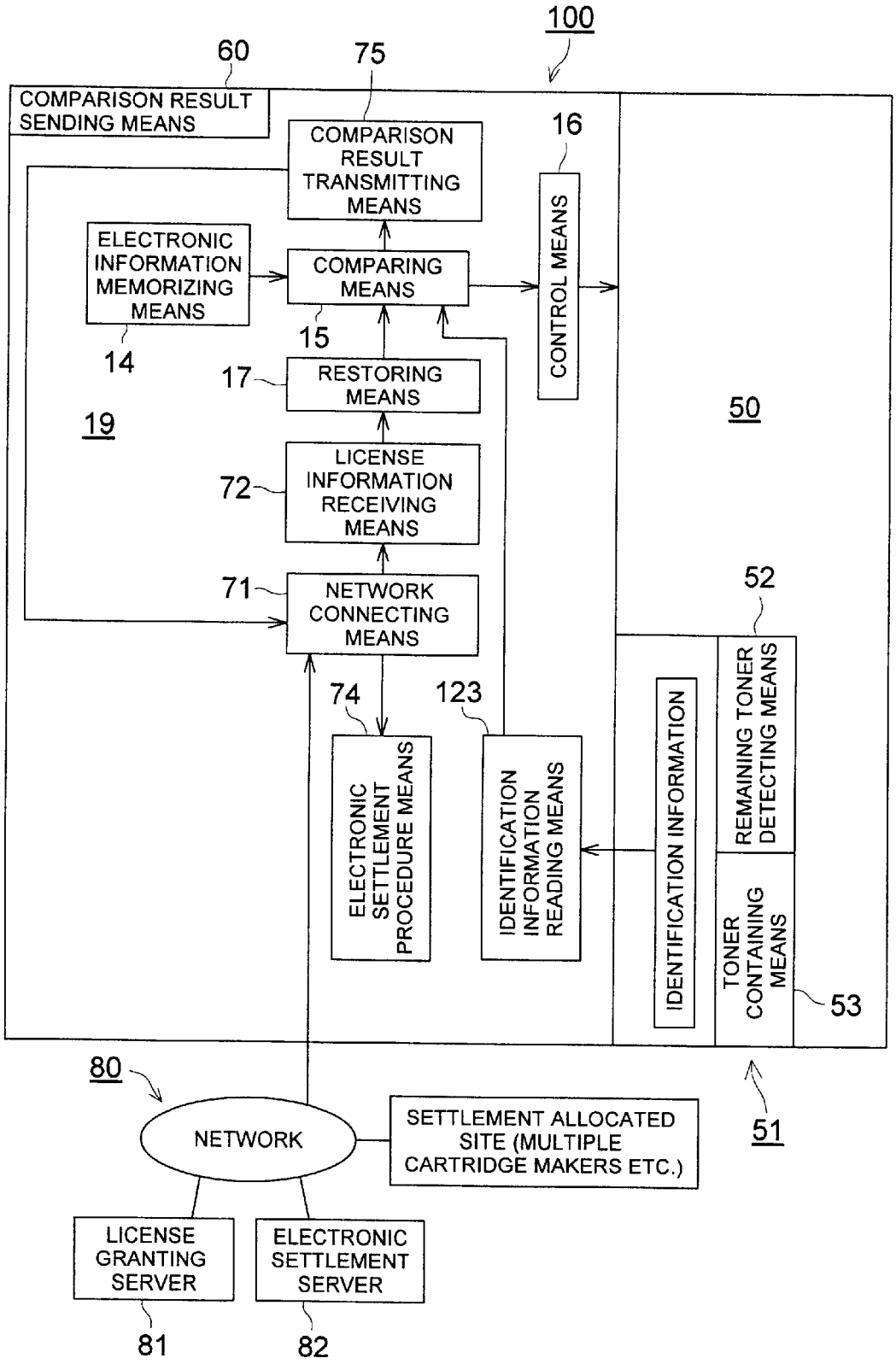
FIG. 5 is a block diagram showing an image forming apparatus having a control means that controls the functions of the image forming means according to the license information received via a network.

FIG. 5 is a block diagram showing an image forming apparatus having a control means that controls functions of an image forming means according to license information received via a network.

Further, FIG. 5 is a block diagram showing an image forming apparatus having an administration means (control means) 18 that administers functions of an image forming means according to the license information received via a network.

As shown in FIG. 5, in an image forming apparatus 100, a network connecting means 71 for connecting to a network, a license information receiving means 72 for receiving the license information, an electronic information memorizing means 14 for memorizing the electronic information corresponding to the license information, a comparing means 15 for comparing the electronic information with the license information, a control means 16 for controlling functions of the image forming means, a decrypting means 17 for decrypting the encrypted license information, and an image forming means 50 which forms images are provided. Further, a connecting means to electronic settlement server (a network connecting means 71) and an electronic settlement proceeding means 74 are provided in the image forming apparatus 100.

Figure 6:
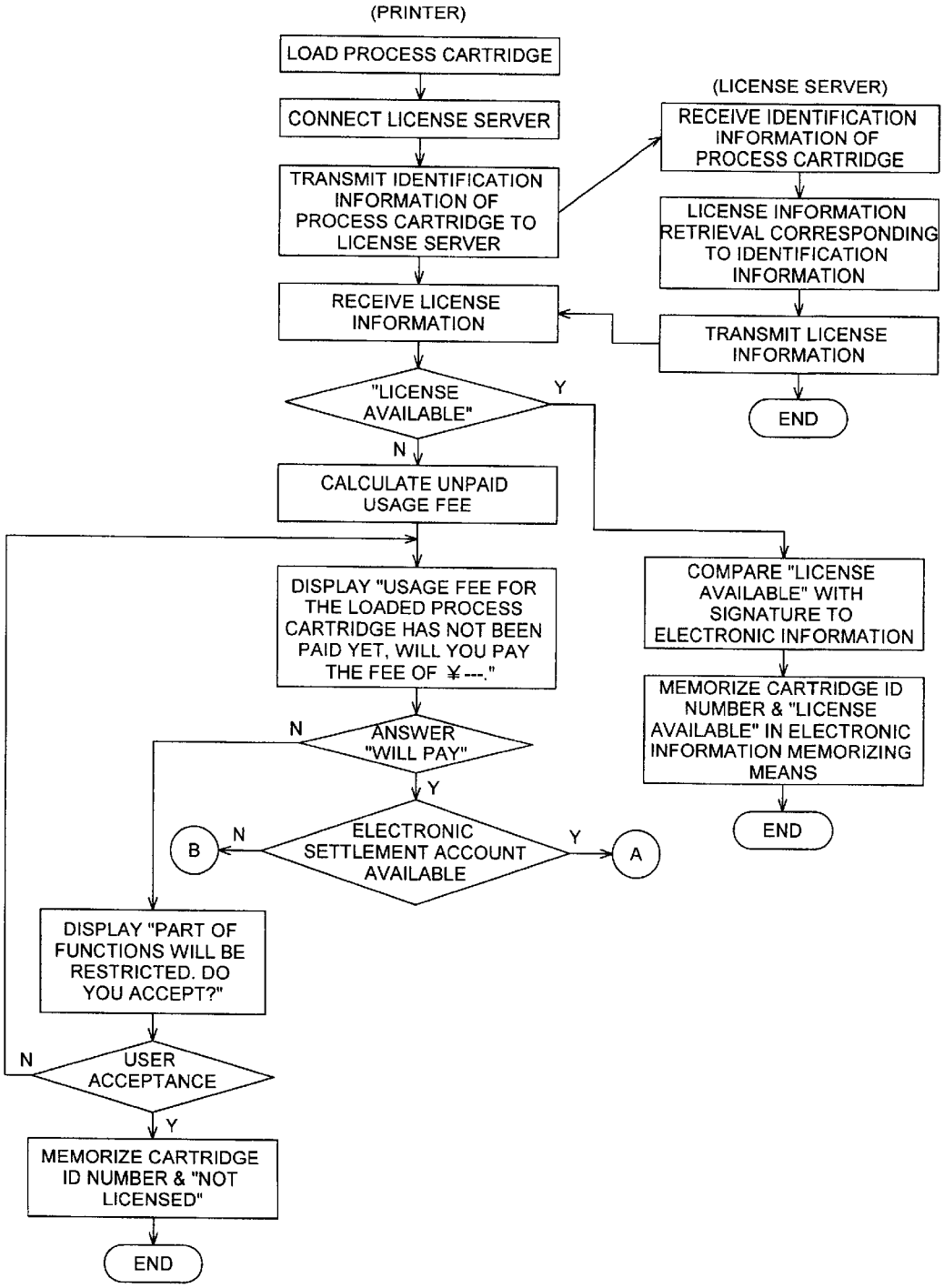
FIG. 6 is a flow diagram showing a control method and an administrating method for a printer, wherein an electrophotographic printer is illustrated as the image forming apparatus in FIG. 5.
Figure 7:
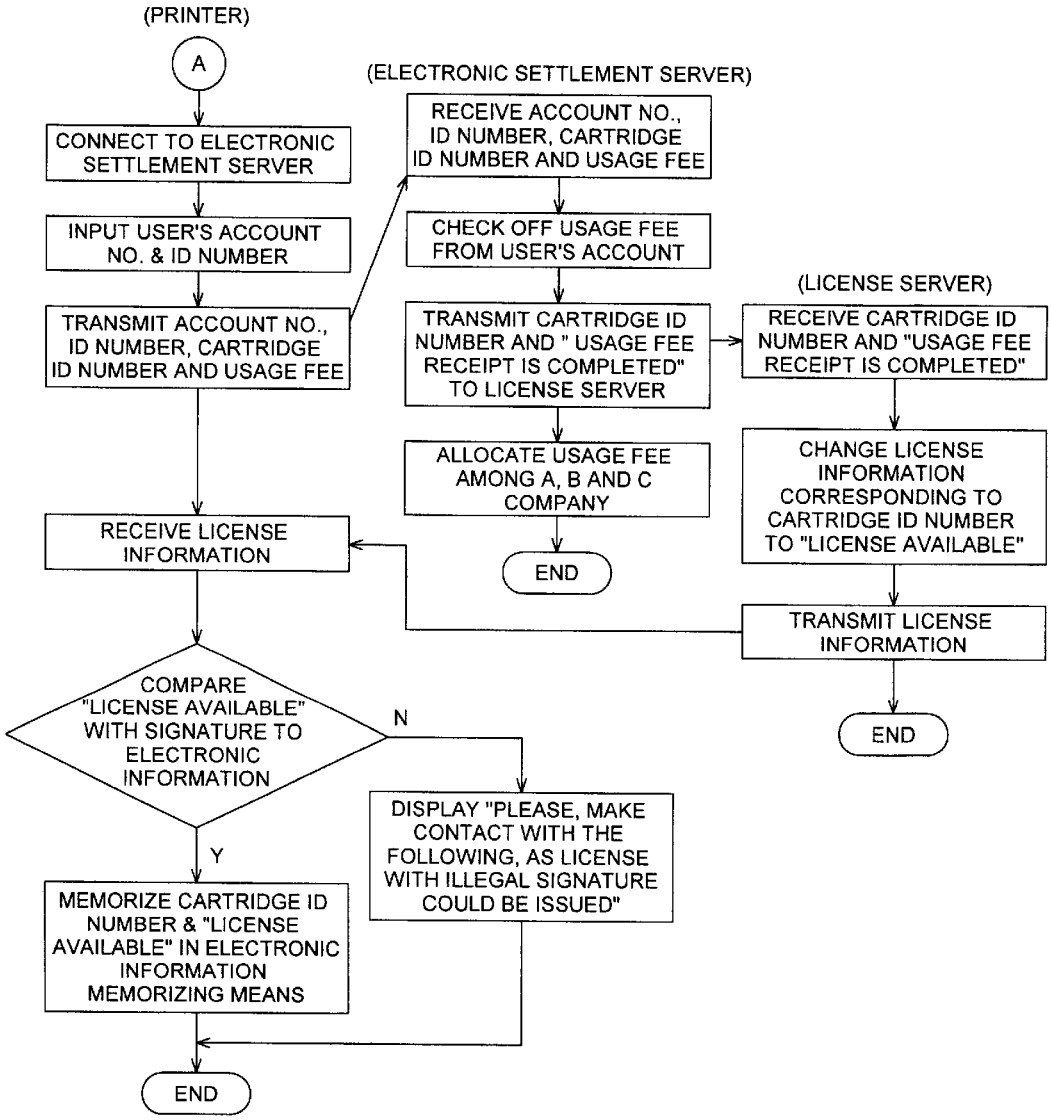
FIG. 7 is a flow diagram (a continuation of A in FIG. 6) showing a control method and an administrating method for a printer, wherein an electrophotographic printer is illustrated as the image forming apparatus in FIG. 5.
Figure 8:
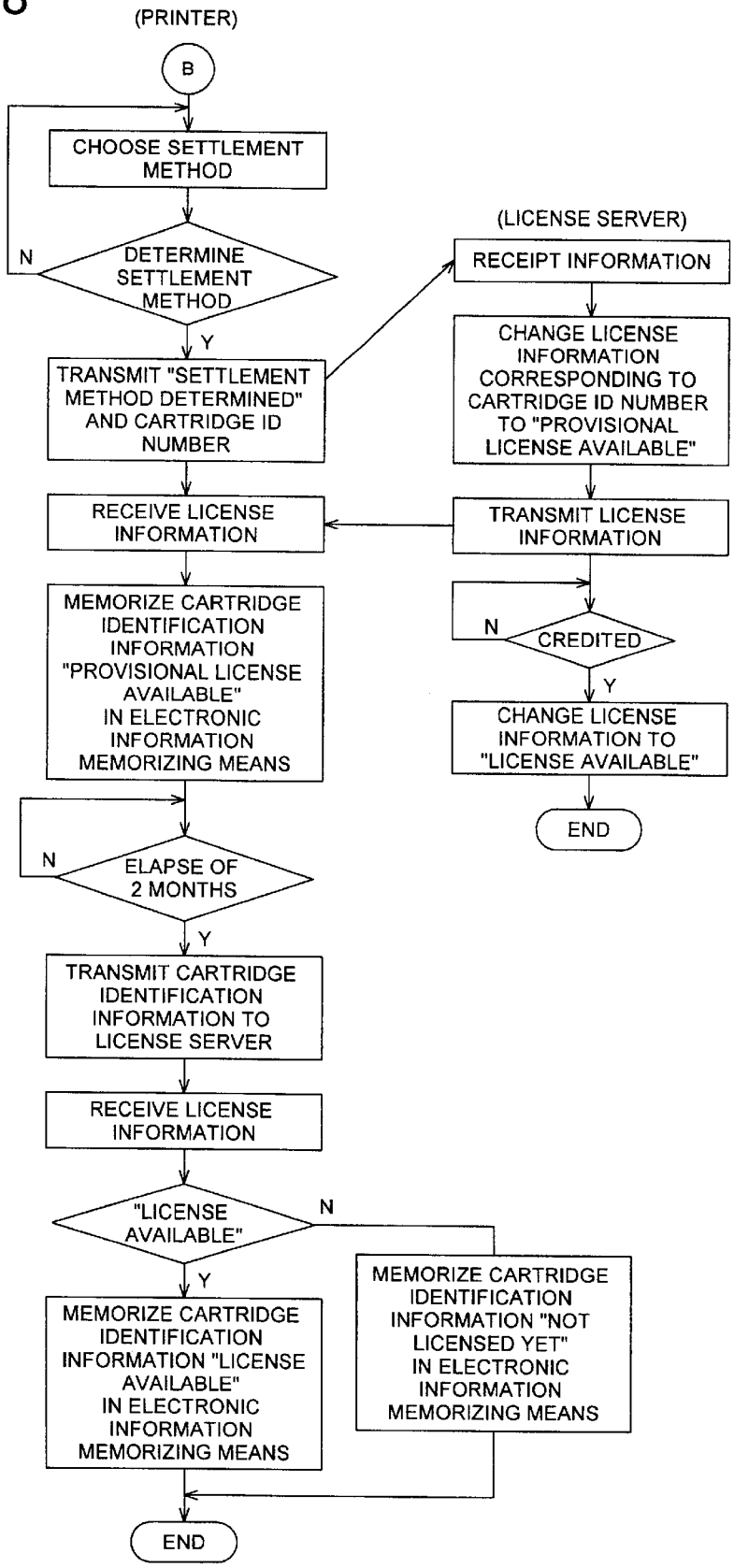
FIG. 8 is a flow diagram (a continuation of B in FIG. 6) showing a control method and an administrating method for a printer, wherein an electrophotographic printer is illustrated as the image forming apparatus in FIG. 5.

By illustrating an electrophotographic printer as the image forming apparatus of FIG. 5, a printer control method and a printer administrating method will be described using flow diagrams of FIGS. 6–8. (FIG. 7 is a continuation of flow diagram after A in FIG. 6, and FIG. 8 is a continuation of flow diagram after B in FIG. 6.)

(1) When the process cartridge 51 is loaded onto the printer 50, image forming functions are automatically activated and the printer main body 100 is connected to the license server 81 via the network connecting means 71.

(2) The process cartridge identification information (manufacturing serial number and manufacturer's information of the process cartridge 51), which is memorized in a built-in memory of the process cartridge, is transmitted to the license granting server 81 by the identification information transmitting means (not illustrated) of the printer 50, and in the license server 81, the identification information is compared with the license presence/absence judgment information existing in the license server 81, and then the license information is generated. Here, the license information includes the usage fee settlement status information of the process cartridge etc., as well as the information of "license available" and "not licensed". Then, the license information is transmitted from the license server 81 to the license information obtaining means 72 of the printer 50.

(3) Based on the usage fee settlement status information of the process cartridge, which is included in the license information received at the license information obtaining means 72, a message of "Usage fee for the loaded process cartridge has not been paid yet. Will you pay the fee?" is displayed on the display means 60 of the printer, whereas if license information is "License available" this message is not displayed.

(4) In cases where the user answered, "Will pay." the network connecting means 71 automatically connects to the electronic settlement server 82, and an administration procedure for usage fee receipt of the image forming apparatus in FIG. 7 is initiated.

(5) In cases where the user has an electronic settlement account in the electronic settlement server 82, the procedure goes to an electronic settlement course A. By user's input of the electronic settlement account number and the user's ID number, into electronic settlement server 82, the usage fee receipt is completed.

Received usage fee is allocated among licensers depending on the type of the process cartridges as shown in Table 1. In this example, in cases where the process cartridge is manufactured by Company B, license fee is allocated to Company A, and in cases where the process cartridge is manufactured by Company A, license fee is allocated to Company C.

(6) When license server 81 receives information of "usage fee receipt is completed", the server transmits the information of "license available" with signature data to the printer.

(7) The printer compares the information of "license available" including signature data with the electronic information previously memorized in the electronic information memorizing means 14, and when both information data conform to each other, information of "license available" for the loaded process cartridge is memorized in the electronic information memorizing means 14.

(8) When the signature data does not conform to the electronic information, a message "Please make contact with the following, as a license with illegal signature could be issued." and a contact address of the printer manufacturer are displayed on the display means 60 of the printer.

(9) In cases where the user does not have an electronic settlement account, the user chooses the settlement method (for example, crediting into a bank account or cash registration) by proceeding to step B.

(10) The license server 81, which received the information of "settlement method is determined" from the electronic settlement server 82, transmits the data of "provisional license available" with signature to the printer. The printer receives the data of "provisional license available" at the license information receiving means 72. The data of "provisional license available" is valid only for two months, and the printer can be used normally only during that period.

(11) When two months have elapsed, the printer again connects to the license server 81 via the network connecting means 71 of the image forming apparatus 100, and if the settlement is completed, information of "license available" with signature is issued from the license server 81, then the information is received by the license information receiving means 72 of the image forming apparatus 100, and information of "license available" for process cartridge 51, which is loaded onto the image forming means 50, is memorized in the electronic information memorizing means 14. If the settlement is not completed, information of "not licensed yet" for the loaded process cartridge is memorized in electronic information memorizing means 14.

(12) In cases where the user answered as "Will not pay", a warning message of, "If used without license, some part of the functions will be restricted. Will you accept?" is displayed on the display means 60 of the printer. And in cases of the user's acceptance, the information of "not licensed yet" for the loaded process cartridge is memorized in the electronic information memorizing means 14.

(13) By the procedures described above, at the time of issuing the license information, allocation of the manufacturing, collecting, and remanufacturing cost among multiple companies becomes possible, and the cost collection can be assured.

TABLE 1

| Manufacturer | Cartridge usage fee (Yen) | License fee (Yen) | |
|---|---|---|---|
| | | Pay to Company A | Pay to Company C |
| Cartridge made by Company A | 5,000 | 0 | 5,000 |
| Cartridge made by Company B | 8,000 | 8,000 | 0 |
| No data of manufacturer | 15,000 | 8,000 | 7,000 |

Herein, the electronic settlement server is an information processing apparatus that can conduct checking off and crediting (i.e. electronic settlement procedure) to bank accounts (i.e. electronic settlement accounts) of users, process cartridge manufacturers, collecting agents and remanufacturers and various rightful owners concerning specific process cartridges. Instructions of checking off and crediting fees to the electronic settlement server is possible only in cases where the user is certified to be authentic.

The connecting means to the electronic settlement server is a generic term of circuits, firmware, and software that connect the image forming apparatus of the present invention to the electronic settlement server, and specifically comprises a network connecting board and connecting software.

The term of "provisional license available" signifies that the condition is provisionally treated as "license available", and in this embodiment the term is defined to be "license available" during a specific period, and the image forming apparatus of the present invention can be used only during the period. For another embodiment, it is possible to define the condition of "provisional license available" to be more restricted in use of functions than "license available" and less restricted than "not licensed yet".

Figure 9:
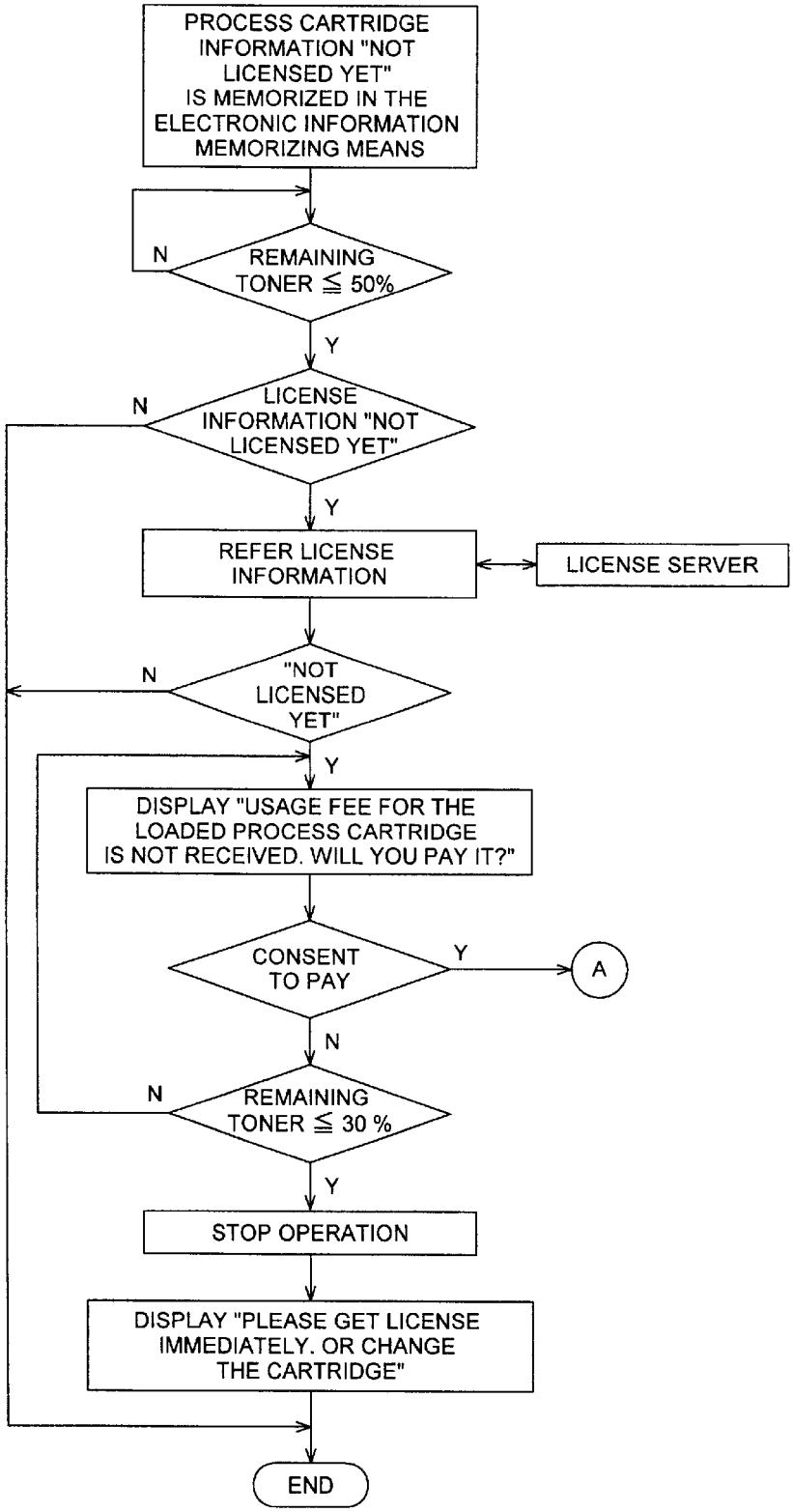
FIG. 9 is a flow diagram showing an example of the function restriction of an image forming apparatus, being conducted when a loaded cartridge is memorized as "not licensed yet", in an electronic information memorizing means.

Meanwhile, in the flow diagram of FIG. 6, an example of restriction of functions, which is conducted when a user accepted, "Part of functions will be restricted", and information of "not licensed yet" for the loaded cartridge is memorized in the electronic information memorizing means 14, is shown in the flow diagram of FIG. 9.

(1) In this example, in cases where the process cartridge is "not licensed yet", operation of the printer is controlled to stop when the residual toner reaches 30%.

(2) When the residual toner detecting means 52 in FIG. 5 detects the residual toner to be 50%, checking whether a license is available or not for the cartridge is done via the network connecting means.

(3) As a result, in cases where the process cartridge is "not licensed yet", a message of, "Usage fee for the process cartridge is not received. Will you pay the fee?" is displayed on the user's display means. If the user accept to pay the fee, the electronic settlement server is connected and the control flow from the step of "electronic settlement account is available or not", in FIG. 6 is repeated. In this case, the provisional license has not been issued.

(4) In cases where the user refuses to pay the fee, when the residual toner detecting means 52 detects the residual toner to be 30% with the condition of "not licensed yet", operation of the printer is stopped and the warning message of "Please get license immediately, or exchange the cartridge" is displayed.

(5) By going through these procedures, users can decrease the initial cost of purchasing the process cartridge.

In the embodiments described above, the license presence/absence judgment information and the identification information are compared in the server, whereas by sending the license presence/absence judgment information from the server to the printer, the comparison of the license presence/absence judgment information with the identification information may be conducted by the comparing means in the printer. In this case, the control means controls the image forming means in the printer according to the comparison result.

FIG. 1 is a block diagram showing an image forming apparatus comprising, a loading/unloading mechanism for the license information recording media having license information, onto an image forming means, and a control means that controls functions of the image forming means in accordance with the license information.

As shown in FIG. 1, in the image forming apparatus 100, provided are a recording media loading/unloading means 11 for license information, a license information reading means 12, a writing means for complete reading of information 13, an electronic information memorizing means 14 for memorizing electronic information, a comparing means 15 for comparing the electronic information with the license information, a control means 16 for controlling functions of the image forming means, a decrypting means 17 for decrypting encrypted license information, and an image forming means 50 for forming images.

License information recording media 10, in which the license information is memorized, is inserted to the recording media loading/unloading means 11 in the image forming apparatus 100. The license information in the recording media is read by the license information reading means 12, and transmitted to the comparing means 15. Meanwhile, the electronic information memorizing means 14, which memorizes the electronic information corresponding to the license information, is provided in the image forming apparatus 100, and the electronic information memorized in the electronic information memorizing means 14 is also transmitted to the comparing means 15, and the license information and the electronic information are compared by the comparing means 15.

As the result of comparing the license information with the electronic information, when both of the information conform to each other, the information of conformity is transmitted to the control means 16 in the image forming means, and the control means allows full functions of image forming means 50 so that the image forming operation starts without restrictions.

On the other hand, when the license information and the electronic information do not conform to each other as a result of the comparison, the information of inconformity is transmitted to the control means 16 in the image forming means, and the control means restricts some of the functions or stops all the functions of the image forming means 50.

Figure 2:
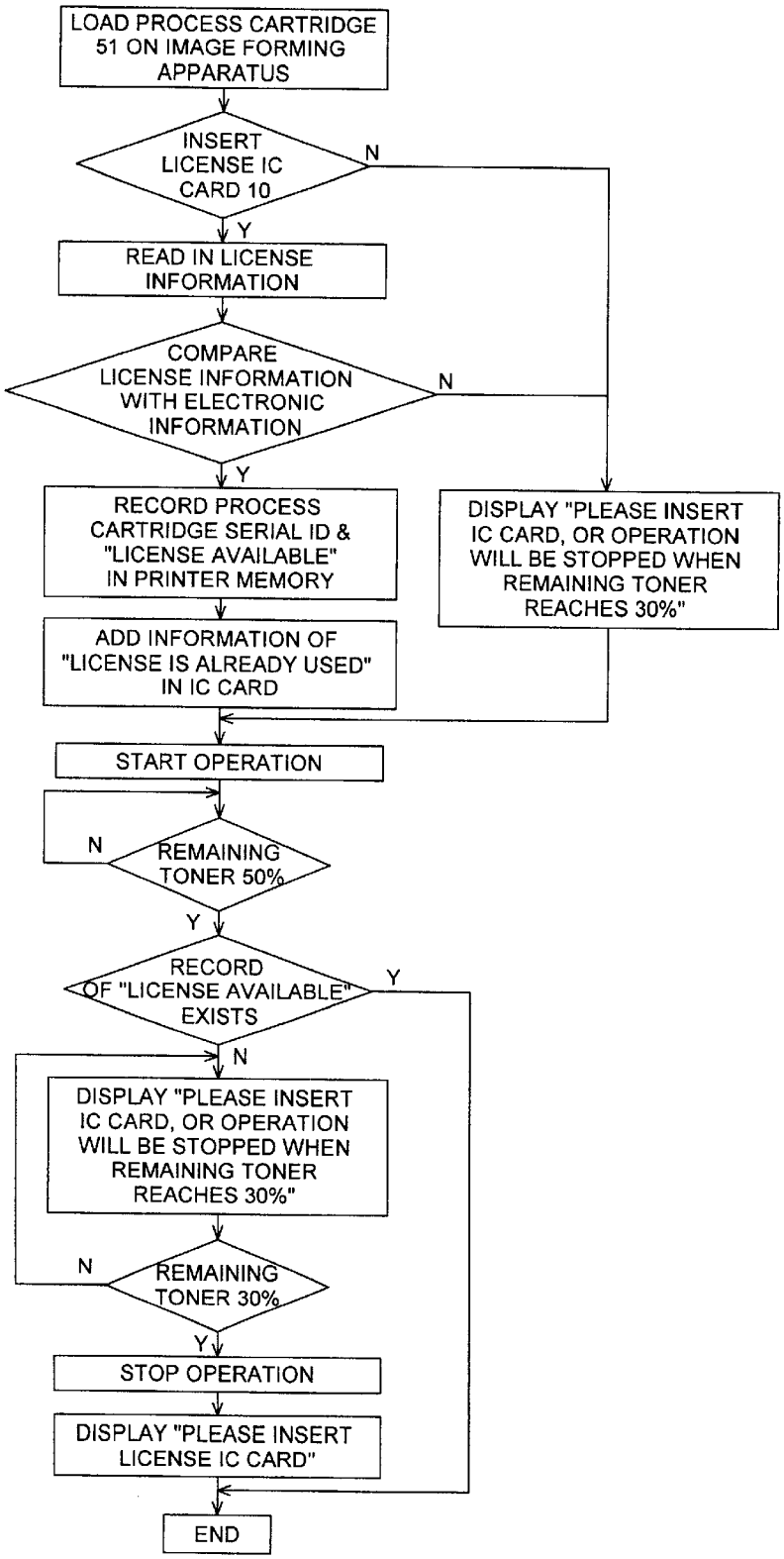
FIG. 2 is a flow diagram of a printer control method, wherein an electrophotographic printer is illustrated as the image forming apparatus in FIG. 1.

By illustrating an electrophotographic printer as the image forming apparatus in FIG. 1, a printer control method will be described using the flow diagram shown in FIG. 2.

(1) Loading the process cartridge 51 onto the image forming means 50.

(2) Inserting the license information recording media 10 (license IC card in this example), which is discrete from process cartridge 51, to the printer via the recording media loading/unloading means 11.

(3) When starting to use the process cartridge, the printer reads in the license information recorded in the license IC card 10.

(4) As the license information, information of "license available" is memorized with an electronic signature.

(5) When the license information, which is read in by the license information reading means 12, conforms to the electronic information previously memorized in the electronic information memorizing means 14 of the printer, the serial ID of the cartridge and the information of "license available" are recorded in the printer memory. After writing the complete reading of information of "license is already used" in the license IC card through the writing means for complete reading of information 13, the control means 16 activates starting operations of the image forming means 50.

(6) In cases where the license IC card is not inserted, or the license information memorized in the license IC card does not conform to the electronic information memorized in the electronic information memorizing means 14, a warning of, "Please insert license IC card, or operation will be stopped when residual toner reaches 30%" will be displayed, and after that, the printer starts operation.

(7) When the residual toner in the toner accommodating means 53 is detected to be 50% by the residual toner detecting means 52, and in cases where "license available" is not recorded, the warning, "Please insert license IC card, or operation will be stopped when residual toner reaches 30%" is displayed.

(8) In cases where the license IC card has still not been inserted and residual toner reaches 30%, the warning, "Please insert IC card, or exchange the cartridge" is displayed.

(9) Users can purchase the cartridge and the license IC card at separate time, so that the initial cost for using a printer can be decreased. Further, the license IC card can be distributed as an independent authorized private document, and the costs for production, collection, and remanufacturing of the cartridge can be assuredly collected.

The electronic signature is the electronic information substituting for a signature or a stamp, which certifies that the concerned license information is authentic, and is preferably encrypted by publicly known encryption system.

The recording media Loading/unloading means 11 for the license information recording media is, specifically, a PC card slot or a loading system for recording discs.

The toner accommodating means is a receptacle provided in the process cartridge, for containing a certain amount of toner. Any publicly known type of container can be used.

The residual toner detecting means is a means for detecting the amount of toner still contained in the toner accommodating means, and can be used any publicly known method such as an optical method, wherein optical sensor attached to a transparent window of the toner accommodating means detects the residual toner by sensing optical transmission/non-transmission characteristics, or a weight measurement method wherein the total weight of the toner accommodating means is measured to detect the residual toner.

In FIG. 1, in cases where the license information memorized in the license information recording media 10 is encrypted information, the license information is read by the license information reading means 12 as encrypted license information, and this encrypted license information is transmitted to decrypting means 17, then the decryptd information is transmitted to the comparing means 15.

Here, the encryption converts the license information to other forms of information in order to discourage it being easily decoded and diverted. Specifically, a certain rule of encryption "key" is used to convert the license information to a seemingly meaningless series of symbols. The decrypting is to convert the encrypted information to readable license information using the "key".

Figure 3:
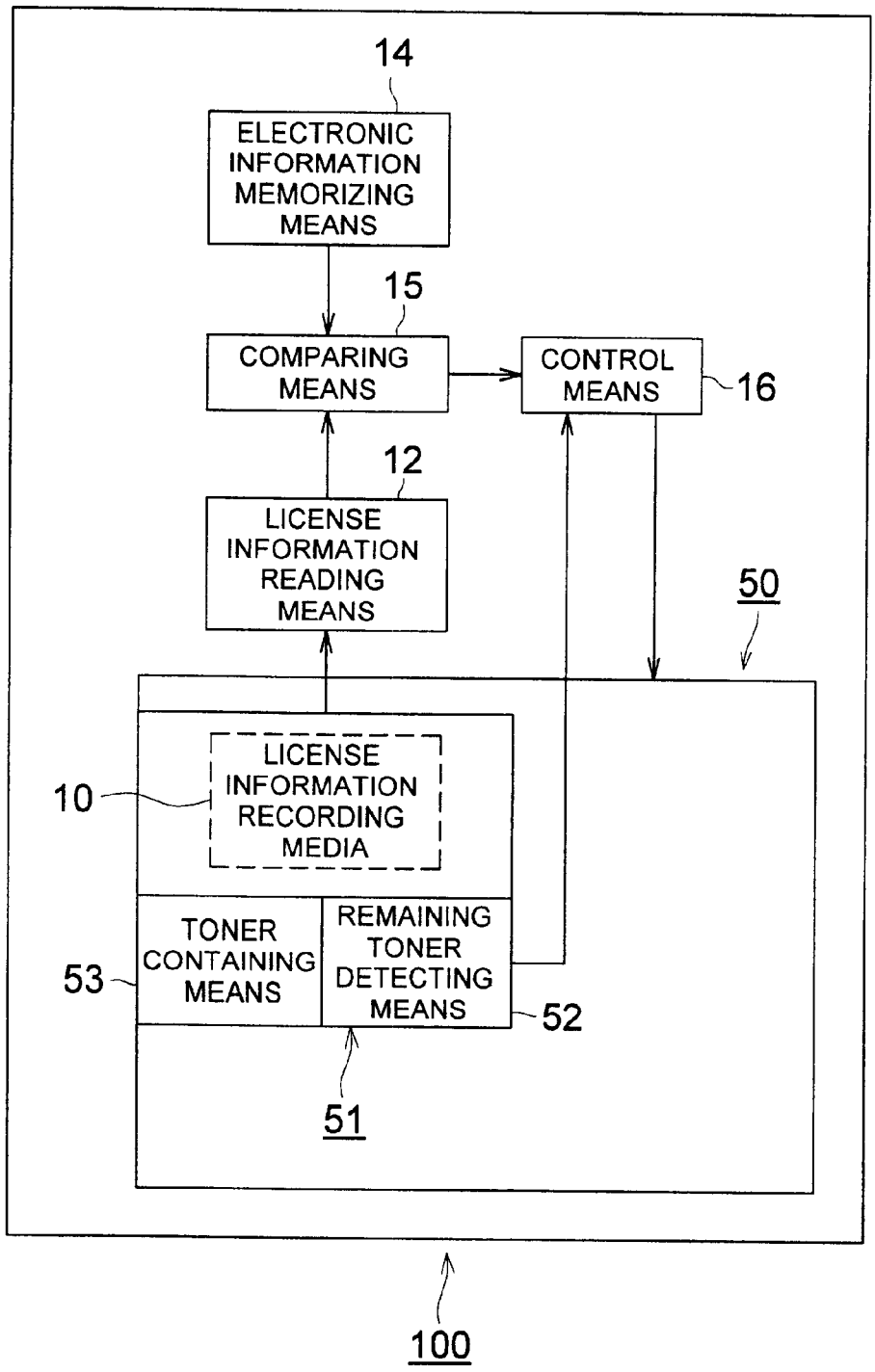
FIG. 3 is a block diagram showing an image forming apparatus comprising a loading/unloading means for a process cartridge having license information, into the image forming means, and a control means that controls functions of the image forming means according to the license information.

FIG. 3 is a block diagram showing the image forming apparatus comprising the loading/unloading mechanism of the process cartridge, which incorporates the license information, into the image forming means, and the control means that controls the functions of image forming means in accordance with the license information.

In the image forming means 50 of the image forming apparatus 100, the loading/unloading mechanism for the process cartridge 51 having the license information is provided, and when the process cartridge is loaded, the license information in the process cartridge 51 is read by the license information reading means 12, and the license information is transmitted to the comparing means 15. Meanwhile, the electronic information memorizing means 14 which memorizes the electronic information corresponding to the license information is provided in the image forming apparatus 100, and the electronic information memorized in the electronic information memorizing means 14 is also transmitted to the comparing means 15, and in the comparing means 15, the license information and the electronic information are compared.

As the result of comparing the license information with the electronic information, in case both of the information conform to each other, for example both are the same, a signal of conformity is transmitted to the control means 16, and the control means allows full functions of image forming means 50 so as to start image forming operation without restrictions.

On the other hand, as the result of comparing the license information and the electronic information, when both of the information does not conform to each other, a signal of inconformity is transmitted to the control means 16, and the control means restricts some of the functions or stops all the functions of the image forming means 50.

Figure 4:
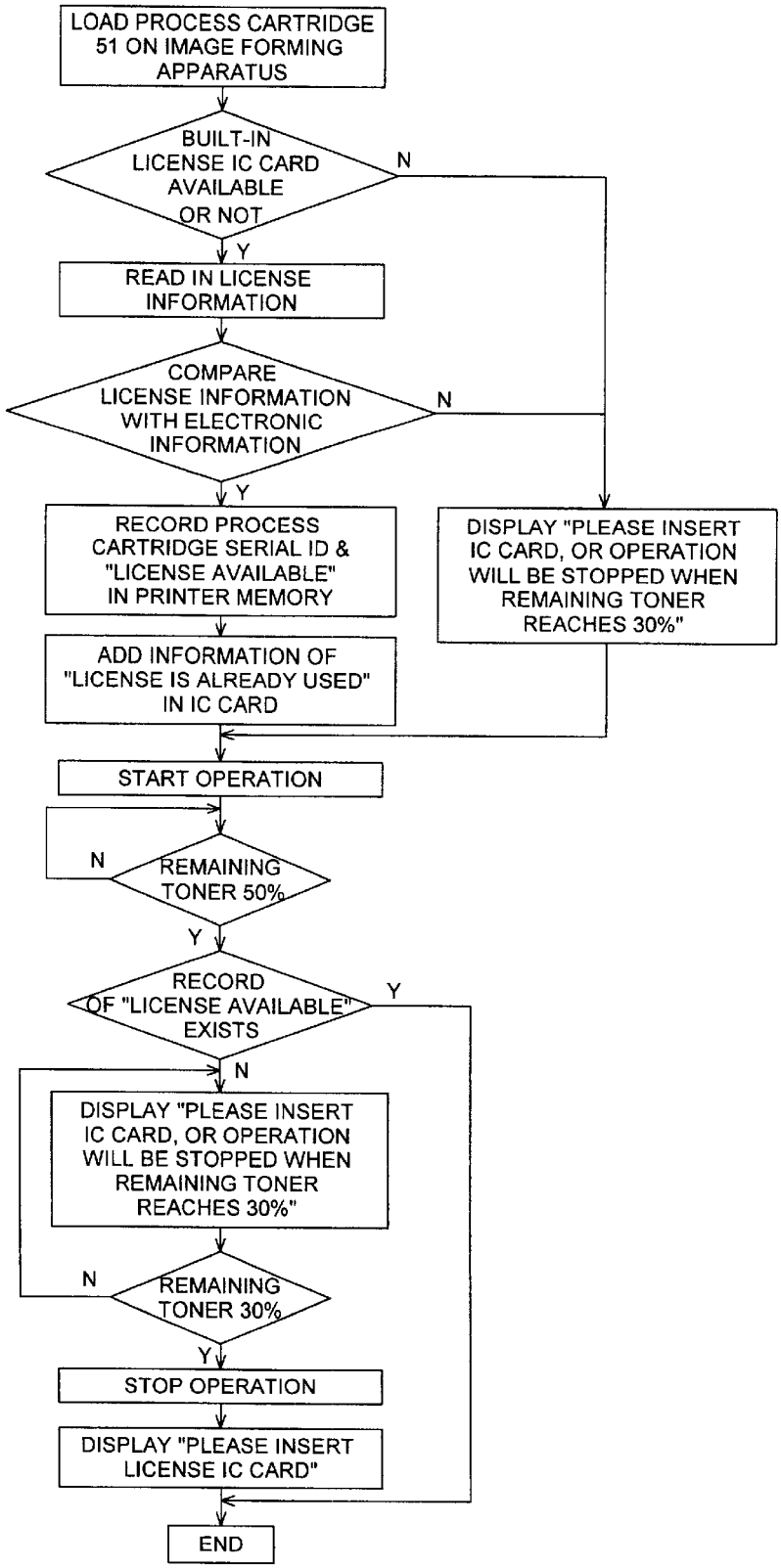
FIG. 4 is a flow diagram of a printer control method, wherein an electrophotographic printer is illustrated as the image forming apparatus in FIG. 3.

By illustrating an electrophotographic printer as the image forming apparatus in FIG. 3, a printer control method will be described using the flow diagram shown in FIG. 4.

(1) Loading the process cartridge 51 onto the image forming means 50.

(2) When starting to use the process cartridge, the printer reads in the license information recorded in the license information recording media 10 (an IC card, in this example) which is provided in the process cartridge 51, by using the license information reading means 12.

(3) As the license information, the information of "license available" is memorized with an electronic signature.

(4) When the license information read in by the license information reading means 12 conforms to the electronic information previously memorized in the electronic information memorizing means 14 of the printer, the serial ID of the cartridge and information of "license available" are recorded in the printer memory, and the control means 16 activates to start operation of the image forming means 50.

(5) When the license information memorized in the license IC card does not conform to the electronic information previously memorized in electronic information memorizing means 14, the warning, "Please insert license IC card, or operation will be stopped when residual toner reaches 30%" will be displayed, and after that, will the printer operation start.

(6) When the residual toner in the toner accommodating means 53 is detected to be 50% by the residual toner detecting means 52, and in cases where "license available" is not recorded, the warning, "Please insert license IC card, or operation will be stopped when residual toner reaches 30%" will be displayed.

(7) In cases where the license IC card has still not been inserted and the residual toner reaches 30%, the warning, "Please insert IC card, or exchange the cartridge" will be displayed.

(8) Users can purchase the cartridge and the license IC card at separate times, so that the initial cost for using a printer can be controlled according to the user's preference. Further, the license IC card can be distributed as an independent authorized-private document, and costs for the production, collection, and remanufacturing of the cartridge can be assuredly collected.

According to the image forming apparatus, control method of image forming apparatus and administrating method of image forming apparatus of the present invention, the collecting cost, the remanufacturing cost and the patent license cost of the process cartridge, which is used in this image forming apparatus and method, is separated from the manufacturing cost of the process cartridge, and information of the separated cost is loaded into the license information recording media, on the process cartridge and on the license granting server in the network as the license information, and the license information is clearly shown to the user, then the user pays the separated costs of collecting, remanufacturing and patent licensing for the process cartridge when using the cartridge. By separating the collecting cost, the remanufacturing cost and the patent license cost of the process cartridge, which is used for the image forming apparatus and method, from the manufacturing cost of the process cartridge, the user's cost burden at the time of purchasing the process cartridge is decreased, and appropriate collection of costs for the manufacturer, the collector and the remanufacturer becomes possible. Through these effects, stable and high quality process cartridges can be provided, and further, a stable and high quality image forming apparatus and a control method of the image forming apparatus as well as an administrating method of the image forming apparatus can be provided.

Disclosed embodiment can be varied by a skilled person without departing from the spirit and scope of the invention.

What is claimed is:

1. An image forming apparatus, comprising:

an image forming section having a detachable process cartridge provided with identification information;

an identification information reading section to read the identification information of the proccss cartridge;

a detachable card receiving section to receive a detachable card separately from the detachable process cartridge, wherein license presence/absence judgment information is stored in the detachable card;

a detachable card reading section to read the license presence/absence judgment information stored in the detachable card; and a control section to judge on a basis of the license presence/absence judgment information whether a license is present or absent in the detachable card and to allow the image forming apparatus to use the detachable process cartridge having the identification information when the control section judges that the license is present in the detachable card.

2. The image forming apparatus of claim 1, further comprising:

an electronic information memorizing section to memorize electronic information representing a password; and a comparison section to compare the electronic information with the license presence/absence judgment information, wherein the control scetion judges based on a comparison result in the comparison section whether a license is present or absent in the detachable card.

3. The image forming apparatus of claim 1, wherein the license information is encrypted and the image forming apparatus further comprises a decrypting section to decrypt the encrypted license information.

4. The image forming apparatus of claim 3, wherein in a case that the license information obtained by the license information obtaining section has information indicating "no license", the control section restricts or stops a function of the image forming section when the residual toner amount detecting section detects a predetermined amount of residual toner.

5. The image forming apparatus of claim 1, wherein the process cartridge comprises a toner accommodating section to accommodate toner and a residual toner amount detecting section to detect an amount of residual toner remaining in the toner accommodating section.

6. An image forming apparatus, comprising:

an image forming section having a detachable process cartridge provided with identification information;

an identification information reading section to read the identification information of the process cartridge;

a control section to control the image forming apparatus on a basis of a comparison result between the identification information and license presence/absence judgment information used for judging whether the process cartridge is licensed or not;

a network connecting section to connect with a network;

an identification information transmitting section to transmit the identification information to a server having the license presence/absence judgment information through the network connecting section; and a license information obtaining section to obtain license information generated in the server on a basis of the comparison result between the identification information arid the license presence/absence judgment information through the network connecting section;

wherein the control section controls the image forming section on a basis of the license information obtained by the license information obtaining section.

7. The imaging forming apparatus of claim 6, further comprising:

an electronic information storing section to store electronic information corresponding to the license information; and a comparing section to compare the license information obtained by the license obtaining section with the electronic information stored in the electronic information storing section;

wherein the control section controls the image forming section on a basis of a comparison result between the license information and the electronic information by the comparing section.

8. The image forming apparatus of claim 6, wherein the license information is encrypted and the image forming apparatus further comprises a decrypting section to decrypt the encrypted license information.

9. The image forming apparatus of claim 6, further comprising:

an electronic settlement server connecting section to connect through the network connecting section with an electronic settlement server to electronically settle a payment on a basis of the license information.

10. The image forming apparatus of claim 9, further comprising:

an electronic settlement proceeding section to conduct settling a use fee on a basis of the license information.

11. The image forming apparatus of claim 6, wherein the process cartridge comprises a toner accommodating section to accommodate toner and a residual toner amount detecting section to detect an amount of residual toner remaining in the toner accommodating section.

12. The image forming apparatus of claim 11, wherein in a case that the license information obtained by the license information obtaining section has information indicating "no license", the control section restricts or stops a function of the image forming section when the residual toner amount detecting section detects a predetermined amount of residual toner.

13. An image forming apparatus, comprising:

an image forming section having a detachable process cartridge provided with identification information;

an identification information reading section to read the identification information of the process cartridge;

a control section to control the image forming apparatus on a basis of a comparison result between the identification information and license presence/absence judgment information used for judging whether the process cartridge is licensed or not;

a network connecting section to connect with a network;

a license presence/absence judgment information obtaining section to obtain the license presence/absence judgment information from a server of the network through the network connecting section; and a comparing section to compare the license presence/absence judgment information with the identification information;

wherein the control section controls the image forming section on a basis of a comparison result by the comparing section.

14. The image forming apparatus of claim 13, further comprising:

an electronic information storing section to store electronic information corresponding to the license presence/absence judgment information;

wherein the comparing section compares the license presence/absence judgment information obtained by the license presence/absence judgement information obtaining section with the electronic information stored in the electronic information storing section and the control section controls the image forming section on a basis of a comparison result between the license presence/absence judgment information and the electronic information by the comparing section.

15. The image forming apparatus of claim 13, wherein the license presence/absence judgment information is encrypted and the image forming apparatus further comprises a decrypting setion to decrypt the encrypted license presence/absence judgment information.

16. The image forming apparatus of claim 13, further comprising:

an electronic settlement server connecting section to connect through the network connecting section with an electronic settlement server to electronically settle a payment in the network on a basis of the comparison result between the identification information and the license presence/absence judgment information.

17. The image forming apparatus of claim 16, further comprising:

an electronic settlement proceeding section to conduct settling a use fee on a basis of the comparison result between the identification information and the license presence/absence judgment information.

18. The image forming apparatus of claim 13, wherein the process cartridge comprises a toner accommodating section to accommodate toner and a residual toner amount detecting section to detect an amount of residual toner remaining in the toner accommodating section.

19. The image forming apparatus of claim 18, wherein in the case that the comparing section judges "no license" as a comparison result between the identification information and the license presence/absence judgment information, the control section restricts or stops a function of the image forming section when the residual toner amount detecting section detects a predetermined amount of residual toner.

20. A method of controlling an image forming apparatus comprising an image forming section having a detachable process cartridge provided with identification information, comprising the steps of:

reading the identification information of the process cartridge;

comparing the identification information with license presence/absence judgment information used for judging whether the process cartridge is licensed or not;

controlling the image forming section on a basis of a comparison result;

connecting the image forming apparatus with a network; and a step of transmitting the identification information to a server in the network through the network, wherein the step of comparing is conducted in the server;

generating license information on a basis of a comparison result between the identification information and the license presence/absence judgment information in the server; and wherein the controlling step controls the image forming apparatus on a basis of the license information.

21. A method of controlling an image forming apparatus comprising an image forming section having a detachable process cartridge provided with identification information, comprising the steps of:

reading the identification information of the process cartridge;

comparing the identification information with license presence/absence judgment information used for judging whether the process cartridge is licensed or not; and controlling the image forming section on a basis of a comparison result, wherein the controlling step controls the image forming apparatus on a basis of the comparison result between the identification information and the license presence/absence judgment information.

22. The method of claim 21, wherein further comprising a step of connecting the image forming apparatus with a network; and a step of obtaining the license presence/absence judgment information through the network and the comparing step is conducted in the image forming apparatus.

* * * * *